US009957750B2

(12) United States Patent
Lin

(10) Patent No.: US 9,957,750 B2
(45) Date of Patent: May 1, 2018

(54) WINDOW COVERING POSITIONAL ADJUSTMENT APPARATUS

(71) Applicant: Whole Space Industries LTD, Taipei (TW)

(72) Inventor: Tzu-Yen Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 0 days. days.

(21) Appl. No.: 15/177,575

(22) Filed: Jun. 9, 2016

(65) Prior Publication Data

US 2017/0356241 A1 Dec. 14, 2017

(51) Int. Cl.

| | |
|---|---|
| ***E06B 9/32*** | (2006.01) |
| ***E06B 9/324*** | (2006.01) |
| ***E06B 9/322*** | (2006.01) |
| *E06B 9/28* | (2006.01) |

(52) U.S. Cl.

CPC ..... *E06B 9/32* (2013.01); *E06B 9/322* (2013.01); *E06B 9/324* (2013.01); *E06B 2009/285* (2013.01)

(58) Field of Classification Search

CPC . E06B 9/32; E06B 9/324; E06B 9/325; E06B 9/322; E06B 2009/3222

See application file for complete search history.

(56) References Cited

U.S. PATENT DOCUMENTS

| | | | |
|---|---|---|---|
| 13,251 | A | 7/1855 | Bixler |
| 2,420,301 | A | 5/1947 | Cusumano |
| 3,129,750 | A | 4/1964 | Brandin |
| 5,482,100 | A | 1/1996 | Kuhar |
| 5,706,876 | A | 1/1998 | Lysyj |
| 6,024,154 | A | 2/2000 | Wang et al. |
| 6,129,131 | A | 10/2000 | Colson |
| 6,234,236 | B1 | 5/2001 | Kuhar |
| 6,283,192 | B1 | 9/2001 | Toti |
| 6,289,965 | B1 | 9/2001 | Ruggles |
| 6,571,853 | B1 | 6/2003 | Ciuca et al. |

(Continued)

FOREIGN PATENT DOCUMENTS

KR 101359513 B1 * 2/2014

OTHER PUBLICATIONS

Search Report for United Kingdom Patent Application No. GB1709063.0 dated Dec. 14, 2017.

*Primary Examiner* — Blair M Johnson
(74) *Attorney, Agent, or Firm* — Buchanan Ingersoll & Rooney PC

(57) ABSTRACT

A window covering includes a positional adjustment mechanism connected to a first rail that includes a spring motor unit, a first lift cord pulley connected to the spring motor unit, a first lift cord collection mechanism having a first roller positioned in the first rail, and a first lift cord that extends from the first lift cord pulley through window covering material such that a portion of the first lift cord passes along the first roller. The first roller is configured so that it only rotates a pre-selected number of revolutions when the window covering material is moved from the extended position to the retracted such that the first roller no longer rotates in the second rotational direction as the window covering material is moved from an extended position to a retracted position after having rotated the pre-selected number of revolutions in the second rotational direction.

10 Claims, 7 Drawing Sheets

(56) References Cited

U.S. PATENT DOCUMENTS

| | | | | |
|---|---|---|---|---|
| 6,601,635 | B2 | 8/2003 | Ciuca et al. | |
| 6,644,372 | B2 | 11/2003 | Judkins | |
| 6,644,373 | B2 | 11/2003 | Palmer | |
| 6,725,897 | B2 | 4/2004 | Palmer | |
| 6,761,203 | B1 | 7/2004 | Huang | |
| 7,021,360 | B2 | 4/2006 | Schroder et al. | |
| 7,025,107 | B2 | 4/2006 | Ciuca | |
| 7,108,038 | B2 | 9/2006 | Welfonder | |
| 7,228,797 | B1 | 6/2007 | Hillman et al. | |
| 7,311,133 | B2 | 12/2007 | Anderson et al. | |
| 7,331,370 | B1 | 2/2008 | Militello et al. | |
| 7,984,745 | B2 | 7/2011 | Wen et al. | |
| 9,045,934 | B1 | 6/2015 | Lynch et al. | |
| 9,149,143 | B2 | 10/2015 | Vestal | |
| 9,217,282 | B2 | 12/2015 | Defenbaugh et al. | |
| 9,246,619 | B2 | 1/2016 | Hole et al. | |
| 9,316,051 | B2 | 4/2016 | Toti | |
| 9,328,554 | B2 | 5/2016 | Toti | |
| 9,410,366 | B2 * | 8/2016 | Kwak | E06B 9/262 |
| 2007/0051477 | A1 | 3/2007 | Fraser et al. | |
| 2007/0056692 | A1 | 3/2007 | Nien et al. | |
| 2010/0243177 | A1 | 9/2010 | Berger | |
| 2012/0111509 | A1 | 5/2012 | Mullet et al. | |
| 2014/0083631 | A1 * | 3/2014 | Huang | E06B 9/322 160/170 |
| 2014/0290871 | A1 | 10/2014 | Muto | |
| 2015/0136336 | A1 * | 5/2015 | Huang | E06B 9/322 160/170 |
| 2016/0265272 | A1 * | 9/2016 | Chen | E06B 9/322 |
| 2016/0298385 | A1 * | 10/2016 | Chen | E06B 9/324 |

* cited by examiner

WINDOW COVERING POSITIONAL ADJUSTMENT APPARATUS

FIELD OF INVENTION

The present innovation relates to window coverings. For example, the present innovation relates to window coverings, mechanisms utilized to help facilitate the positional adjustment of window covering material, and methods of making and using the same.

BACKGROUND OF THE INVENTION

Window coverings can be configured so that a material is moveable to partially or fully cover a window. Examples of window coverings can be appreciated from U.S. Pat. Nos. 7,984,745, 7,331,370, 7,311,133, 7,228,797, 7,108,038, 7,025,107, 7,021,360, 6,761,203, 6,725,897, 6,644,373, 6,644,372, 6,601,635, 6,571,853, 6,289,965, 6,234,236, 6,283,192, 6,129,131, 6,024,154, 5,706,876, 5,482,100, 3,129,750, 2,420.301, and 13,251 and U.S. Pat. App. Pub. Nos. 2012/0111509, 2010/0243177, 2007/0056692, and 2007/0051477.

Spring motors that may be employed in window coverings can often include spring elements that can add substantial cost to the spring motor unit. For instance, the spring member of the spring motor unit may require use of a substantial transmission system as disclosed in U.S. Pat. No. 6,283,192 or may require use of a type of spring member that has a special construction that can be expensive to help facilitate the support of the variable load of the window covering material as that material is raised or lowered.

SUMMARY OF THE INVENTION

I have determined that a new window covering design is needed that can permit effective height adjustment of window covering material while also permitting the use of a less expensive spring element and have developed a new window covering, window covering positional adjustment mechanism, and methods of making and using the same. In some embodiments, the window covering can be configured as a cordless window covering that does not have any exposed operator cord. In other embodiments, the window covering can include exposed lift cords, an exposed operator cord or operator wand, and/or exposed venetian blind ladder cords or ladder tape.

In some embodiments, a window covering includes a first rail, window covering material that is connected to the first rail such that the window covering material is moveable between an extended position and a retracted position, and a positional adjustment mechanism connected to the first rail. The positional adjustment mechanism can include a spring motor unit, a first lift cord pulley connected to the spring motor unit, a first lift cord collection mechanism comprising a first roller positioned in the first rail, and a first lift cord having a first terminal end and a second terminal end opposite the first terminal end where the first terminal end of the first lift cord is connected to the first lift cord pulley. The first lift cord can extend from the first lift cord pulley through the window covering material such that a portion of the first lift cord passes along the first roller. The first roller can be configured such that the first roller rotates in a first rotational direction when the window covering is moved from the retracted position to the extended position. The first roller can also be configured to rotate in a second rotational direction that is opposite the first rotational direction for only a pre-selected number of revolutions when the window covering material is moved from the extended position to the retracted position such that the first roller no longer rotates in the second rotational direction as the window covering material is moved from the extended position to the retracted position after having rotated the pre-selected number of revolutions in the second rotational direction during retraction of the window covering material.

In a number of embodiments, the first lift cord may move along the first roller during retraction and extension of the window covering material. For instance, the first lift cord may move along an exterior surface of the first roller during retraction and extension of the window covering material.

The pre-selected number of revolutions can be any of a number of possible pre-selected numbers. For instance, the pre-selected number of revolutions can be one of: five revolutions, three revolutions, 1 revolution, 0.5 revolutions, 0.25 revolutions. The pre-selected number of revolutions can also be another number such as, for example, 10 revolutions, 2 revolutions, or 0.1 revolutions.

The first roller of the first lift cord collection mechanism can have a number of different configurations. In some embodiments, the first roller can include a first outer tubular body and a second inner tubular body positioned within the first outer tubular body such that the first outer tubular body is rotatable relative to the second inner tubular body. The second inner tubular body can have a groove defined in an exterior surface of the second inner tubular body. A ball can be positioned within the groove between the first outer tubular body and the second inner tubular body. The ball can be moveable within the groove during rotation of the first outer tubular body. The first roller can also include a rod positioned within the first outer tubular body to contact the ball during rotation of the first outer tubular body to drive motion of the ball within the groove. The groove can be configured to have different depths within the second inner tubular body. In some embodiments, the groove can be configured so that the rod contacts the ball and binds against the ball to prevent rotation of the first outer tubular body after the first outer tubular body has rotated in the second rotational direction no more than the pre-selected number of revolutions. The groove can also be configured such that the rod passes over the ball when the first outer tubular body rotates in the first rotational direction.

In other embodiments, the first roller can be configured to include a first outer tubular body, a second inner tubular body positioned within the first outer tubular body such that the first outer tubular body is rotatable relative to the second inner tubular body, and a plurality of balls. The second inner tubular body can have a plurality of teeth positioned adjacent a plurality of slots defined within the first outer tubular body and the balls can be positioned within the slots of the first outer tubular body and the second inner tubular body such that the balls are moveable along an outer surface of the second inner tubular body when the first outer tubular body is rotated in the first rotational direction. The balls can be bindable (e.g. in contact with, in engagement with, etc.) against the teeth when the first outer tubular body is rotated in the second rotational direction after the first outer tubular body has rotated the pre-selected number of revolutions (e.g. 0.2 revolutions, 0.3 revolutions, 0.4 revolutions, 0.75 revolutions, 0.9 revolutions, 1.0 revolutions, etc.) to prevent the first outer tubular body to further rotate to prevent further rotation of the first roller in the second rotational direction. In some embodiments, each of the balls may be positioned in a first end of a respective one of the slots when the first outer tubular body is rotated in the first rotational direction and is located in the second end of the respective one of the slots after the first outer tubular body is rotated in the second rotational direction that pre-selected number of revolutions so that the ball binds against a respective tooth of the teeth of the second inner tubular body. In other embodiments, the slots of the first outer tubular body can be configured to be in communication with immediately adjacent slots so that the balls are moveable through all of the slots during rotation of the first outer tubular body in the first rotational direction and are configured to be held in an end of a respective one of the slots after the first outer tubular body has rotated the pre-selected number of revolutions to bind against a respective one of the teeth of the second inner tubular body to prevent further rotation of the first outer tubular body in the second rotational direction. The balls may move along an outer surface of the second inner tubular body as the first outer tubular body rotates in the first rotational direction and pass over the teeth or distal points of the teeth as they move from one slot to an immediately adjacent slot as the first outer tubular body rotates in the first rotational direction.

Embodiments of the window covering can include other elements. For instance, the window covering can include a second rail. The second rail may be a bottom rail in some embodiments. For such embodiments, the first rail may be a headrail or an intermediate rail of a top down bottom up window covering.

Some embodiments of the window covering can include one or more second rail pulleys. For example, some embodiments can include a first second rail pulley positioned in a second rail. A portion of the first lift cord can extend along the first second rail pulley such that the first lift cord has at least two vertically extending segments passing through the window covering material between the first rail and the second rail.

The first cord collection mechanism can also comprise a second roller. The second terminal end of the first lift cord can be connected to the second roller. The first lift cord collection mechanism can also have a housing. The first roller can be connected to the housing and the second roller can be connected to the housing such that the second roller is above the first roller.

The spring motor unit can include a number of possible configurations. For instance, the spring motor unit can include a first spring motor pulley, a second spring motor pulley, and a spring member extending between the first and second spring motor pulleys. The first spring motor pulley can be connected to the first lift cord pulley such that the first lift cord pulley rotates in a same direction as the first spring motor pulley when the first spring motor pulley rotates. In yet other embodiments, the spring motor unit can include a number of different spring motors that each include first and second spring motor pulleys and a spring member extending therebetween. The multiple spring motors may be aligned in parallel so that the first spring motor pulleys are all rotatable along the same rotational axis defined by the same rotational axle and the second spring motors are all rotatable along the same rotational axis defined by the same rotational axle.

Embodiments of the window covering can also include a second lift cord pulley connected to the second spring motor pulley and a second lift cord collection mechanism comprising a first roller positioned in the first rail. A second lift cord having a first terminal end connected to the second lift cord pulley can also be included in such embodiments. The second lift cord can extend from the second lift cord pulley through the window covering material such that a portion of the second lift cord passes along the first roller of the second lift cord collection mechanism. The second lift cord can also have a second terminal end opposite the first terminal end. The first roller of the second lift cord collection mechanism can be configured such that the first roller rotates in a first rotational direction when the window covering is moved from the retracted position to the extended position. The first roller of the second lift cord collection mechanism also configured to rotate in a second rotational direction that is opposite the first rotational direction for only a pre-selected number of revolutions when the window covering material is moved from the extended position to the retracted such that the first roller no longer rotates in the second rotational direction as the window covering material is moved from the extended position to the retracted position after having rotated the pre-selected number of revolutions in the second rotational direction during retraction of the window covering material. The second lift cord may move along the first roller of the second lift cord collection mechanism during retraction and extension of the window covering material.

The second spring motor pulley can be connected to the second lift cord pulley such that the second lift cord pulley rotates in a same direction as the second spring motor pulley when the second spring motor pulley rotates. In some embodiments, such a connection can be provided by at least one gear between the second spring motor pulley and the second lift cord pulley or by teeth that may intermesh that extend between the second spring motor pulley and the second lift cord pulley.

For some embodiments of the spring motor unit, the spring member can have a first end connected to the first spring motor pulley and a second end connected to the second spring motor pulley such that the first and second sprint motor pulleys rotate in a same rotational direction when the window covering material is retracted and also rotate in a same rotational direction when the window covering material is retracted. For such embodiments, the first lift cord pulley can have teeth that intermesh with teeth extending from the first spring motor pulley to connect the first lift cord pulley to the first spring motor pulley and the second lift cord pulley can have teeth that intermesh with teeth extending from the second spring motor pulley to connect the second lift cord pulley to the second spring motor pulley. Alternatively, there may be one or more gears that are positioned between the first spring motor pulley and the first lift cord pulley and one or more gears positioned between the second spring motor pulley and the second lift cord pulley to provide such a connection between the first and second lift cord pulleys and the spring motor unit so that the pulleys of the spring motor unit rotate in a same direction as the first and second lift cord pulleys during retraction and extension of the window covering material.

In some embodiments of the window covering, there may also be a second second rail pulley positioned in the second rail. A portion of the second lift cord can extend along the second second rail pulley such that the second lift cord has at least two vertically extending segments passing through the window covering material between the first rail and the second rail. For such embodiments, the second lift cord collection mechanism can also comprise a second roller. The second terminal end of the second lift cord can be connected to the second roller of the second lift cord collection mechanism. The second lift cord collection mechanism can also have a housing. The first roller of the second lift cord collection mechanism can be connected to the housing of the second lift cord collection mechanism and the second roller can be connected to the housing of the second lift cord collection mechanism such that the second roller of the second lift cord collection mechanism is above the first roller of the second lift cord collection mechanism.

Embodiments of the window covering can also be configured to include a first rail, window covering material that is connected to the first rail such that the window covering material is moveable between an extended position and a retracted position, a second rail, and a positional adjustment mechanism connected to the first rail. The positional adjustment mechanism can include a spring motor unit having a first spring motor pulley, a second spring motor pulley, and a spring member extending between the first and second spring motor pulleys, a first lift cord pulley connected to the first spring motor pulley of the spring motor unit, a second lift cord pulley connected to the second spring motor pulley of the spring motor unit, a first lift cord collection mechanism comprising a first roller positioned in the first rail adjacent a first end of the first rail and a second lift cord collection mechanism comprising a first roller positioned in the first rail adjacent a second end of the first rail, a first lift cord having a first terminal end and a second terminal end opposite the first terminal end where the first terminal end of the first lift cord is connected to the first lift cord pulley and the first lift cord extends from the first lift cord pulley through the window covering material such that a portion of the first lift cord passes along the first roller, and a second lift cord having a first terminal end and a second terminal end opposite the first terminal end where the first terminal end of the second lift cord is connected to the second lift cord pulley and the second lift cord extends from the second lift cord pulley through the window covering material such that a portion of the second lift cord passes along the first roller of the second lift cord collection mechanism. The first roller of the first lift cord collection mechanism can be configured such that the first roller rotates in a first rotational direction when the window covering is moved from the retracted position to the extended position and the first roller of the first lift cord collection mechanism is also configured to rotate in a second rotational direction that is opposite the first rotational direction for only a pre-selected number of revolutions when the window covering material is moved from the extended position to the retracted position such that the first roller of the first lift cord collection mechanism no longer rotates in the second rotational direction as the window covering material is moved from the extended position to the retracted position after having rotated the pre-selected number of revolutions in the second rotational direction during retraction of the window covering material. The first roller of the second lift cord collection mechanism can be configured such that the first roller rotates in a first rotational direction when the window covering is moved from the retracted position to the extended position and the first roller of the second lift cord collection mechanism is also configured to rotate in a second rotational direction that is opposite the first rotational direction for only a pre-selected number of revolutions when the window covering material is moved from the extended position to the retracted position such that the first roller of the second lift cord collection mechanism no longer rotates in the second rotational direction as the window covering material is moved from the extended position to the retracted position after having rotated the pre-selected number of revolutions in the second rotational direction during retraction of the window covering material.

Embodiments of the window covering can include a first second rail pulley positioned in the second rail such that a portion of the first lift cord extends along the first second rail pulley such that the first lift cord has at least two vertically extending segments passing through the window covering material between the first rail and the second rail. Such embodiments can also include a second second rail pulley positioned in the second rail. A portion of the second lift cord can extend along the second second rail pulley such that the second lift cord has at least two vertically extending segments passing through the window covering material between the first rail and the second rail.

The first roller of the first lift cord collection mechanism and the first roller of the second lift cord collection mechanism can each include a first outer tubular body and a second inner tubular body positioned within the first outer tubular body such that the first outer tubular body is rotatable relative to the second inner tubular body. The second inner tubular body can have a groove defined in an exterior surface of the second inner tubular body. A ball can be positioned within the groove between the first outer tubular body and the second inner tubular body such that the ball is moveable within the groove during rotation of the first outer tubular body. The first roller of the first lift cord collection mechanism and the first roller of the second lift cord collection mechanism can each also include a rod positioned within the first outer tubular body to contact the ball during rotation of the first outer tubular body to drive motion of the ball within the groove.

In other embodiments, the first roller of the first lift cord collection mechanism and the first roller of the second lift cord collection mechanism can each be configured to include a first outer tubular body, a second inner tubular body positioned within the first outer tubular body such that the first outer tubular body is rotatable relative to the second inner tubular body, and a plurality of balls. The second inner tubular body can have a plurality of teeth positioned adjacent a plurality of slots defined within the first outer tubular body and the balls can be positioned within the slots of the first outer tubular body and the second inner tubular body such that the balls are moveable along an outer surface of the second inner tubular body when the first outer tubular body is rotated in the first rotational direction. The balls can be bindable (e.g in contact with, in engagement with, etc.) against the teeth when the first outer tubular body is rotated in the second rotational direction after the first outer tubular body has rotated the pre-selected number of revolutions to prevent the first outer tubular body to further rotate to prevent further rotation of the first roller in the second rotational direction. In some embodiments, each of the balls may be positioned in a first end of a respective one of the slots when the first outer tubular body is rotated in the first rotational direction and is located in the second end of the respective one of the slots after the first outer tubular body is rotated in the second rotational direction that pre-selected number of revolutions so that the ball binds against a respective tooth of the teeth of the second inner tubular body. In other embodiments, the slots of the first outer tubular body can be configured to be in communication with immediately adjacent slots so that the balls are moveable through all of the slots during rotation of the first outer tubular body in the first rotational direction and are configured to be held in an end of a respective one of the slots after the first outer tubular body has rotated the pre-selected number of revolutions to bind against a respective one of the teeth of the second inner tubular body to prevent further rotation of the first outer tubular body in the second rotational direction. The balls may move along an outer surface of the second inner tubular body as the first outer tubular body rotates in the first rotational direction and pass over the teeth or distal points of the teeth as they move from one slot to an immediately adjacent slot as the first outer tubular body rotates in the first rotational direction.

The first lift cord pulley, the second lift cord pulley, the first spring motor pulley, and the second spring motor pulley can be configured to all rotate in a same direction when the window covering material is extended and are also configured to rotate in a same direction when the window covering material is retracted. For such embodiments, the first roller of the first lift cord collection mechanism and the first roller of the second lift cord collection mechanism may also be configured to rotate in the same rotational direction during retraction and extension of the window covering material. The rotational direction of the first rollers of the first and second lift cord collection mechanisms may be a different rotational direction that the rotational direction of the first and second lift cod pulleys and first and second spring motor pulleys.

Embodiments of the window covering may also have other configurations. For instance, some embodiments of the window covering can include a first rail, window covering material that is connected to the first rail such that the window covering material is moveable between an extended position and a retracted position, and a positional adjustment mechanism connected to the first rail. The positional adjustment mechanism can include a spring motor unit, a first lift cord pulley connected to the spring motor unit, a first lift cord collection mechanism comprising a first roller positioned in the first rail, and a first lift cord having a first terminal end and a second terminal end opposite the first terminal end. The first terminal end of the first lift cord can be connected to the first lift cord pulley. The first lift cord can extend from the first lift cord pulley through the window covering material such that a portion of the first lift cord passes along the first roller. The first roller can be configured such that the first roller rotates in a first rotational direction when the window covering is moved from the extended position to the retracted position and the first roller can be configured to rotate in a second rotational direction that is opposite the first rotational direction for only a pre-selected number of revolutions when the window covering material is moved from the retracted position to the extended position such that the first roller no longer rotates in the second rotational direction as the window covering material is moved from the retracted position to the extended position after having rotated the pre-selected number of revolutions in the second rotational direction during extension of the window covering material. In some embodiments of this window covering, the first rail may be a bottom rail of the window covering. In other embodiments, the first rail may be an intermediate rail or other rail of a window covering.

Embodiments of the window covering can also include a slat control mechanism. In some embodiments, the slat control mechanism can include a shaft or a tilt rod connected to at least one ladder cord tilt pulley or a plurality of spaced apart ladder cord tilt pulleys. For instance, a first ladder cord tilt pulley can be positioned adjacent a housing to which a first roller is connected. The first ladder cord tilt pulley can be located above the first roller. The first ladder cord tilt pulley can be connected to the shaft or the tilt rod such that rotation of the shaft causes the first ladder cord tilt pulley to rotate. An operator wand may be connected to the shaft or tilt rod via an operator wand gear connected to the operator wand having teeth intermeshed with teeth of a gear attached to the tilt rod or the shaft so that rotation of the wand in one rotational direction causes the operator wand gear to rotate about a vertically extending axis in a first direction to drive rotational motion of the tilt rod or shaft about a horizontal axis in a first direction and rotation of the wand in an opposite rotational direction causes the operator wand gear to rotate about the vertically extending axis in a second direction to drive rotational motion of the tilt rod or shaft about a horizontal axis in a second direction. The rotation of the tilt rod or shaft can cause ladders that support slats to change positions to effect titling of slats between open and closed positions. The ladders can be cord ladders. The cord ladders may be composed of tape or cords. In some embodiments, each ladder can include a single cord or tape that has different segments form front and rear rails of the ladder. In other embodiments, the front and rear rails of the ladder can be composed of interconnected cords or tape. Rungs of the ladder may be composed of cord or tape that extends between the front and rear rails for supporting a slat thereon.

Other details, objects, and advantages of the window covering, window covering positional adjustment mechanism, and methods of making and using the same will become apparent as the following description of certain exemplary embodiments thereof proceeds.

BRIEF DESCRIPTION OF THE DRAWINGS

Exemplary embodiments of the window covering, window covering positional adjustment mechanism, and methods of making the same are shown in the accompanying drawings. It should be understood that like reference numbers used in the drawings may identify like components.

DETAILED DESCRIPTION OF EXEMPLARY EMBODIMENTS

Figure 1:
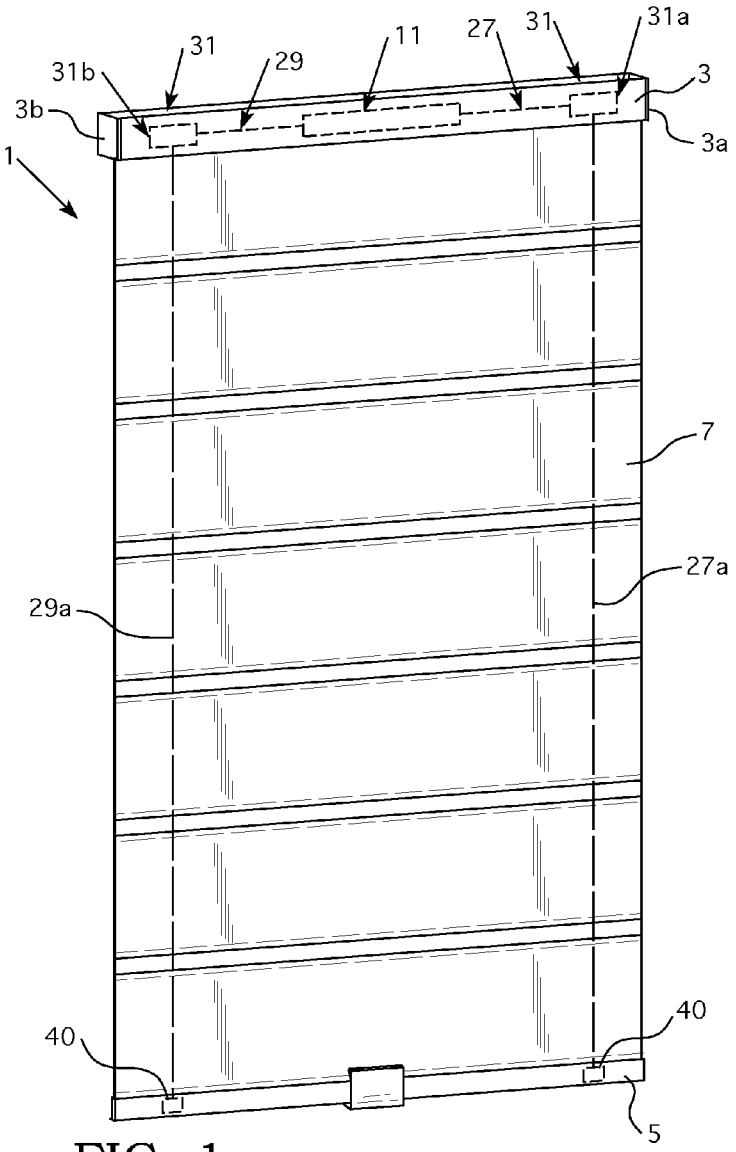
FIG. 1 is a perspective view of a first exemplary embodiment of my window covering in a first extended position.
Figure 2:
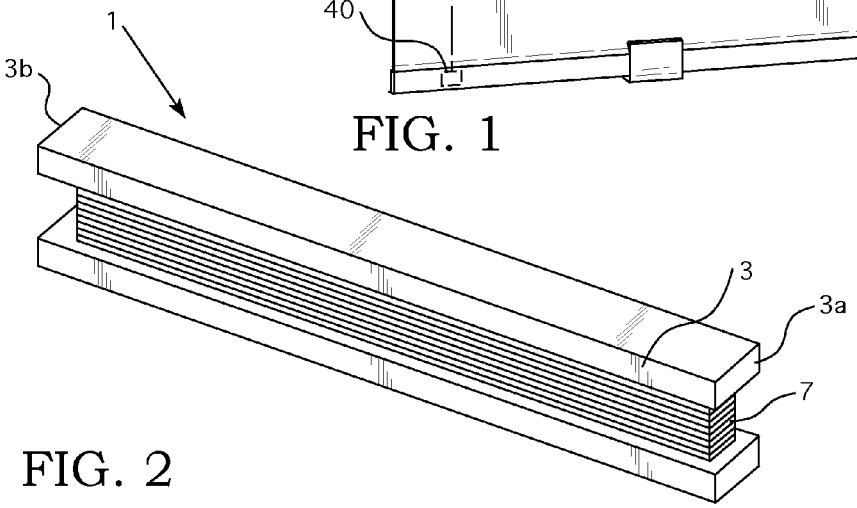
FIG. 2 is a perspective view of a second exemplary embodiment of my window covering in a second retracted position.

As can be appreciated from FIGS. 1-10, embodiments of the window covering can include a height adjustment mechanism for controlling the raising and lowering of window covering material. Embodiments of the window covering can be configured to permit the window covering material to be raised and lowered without use of lift cords passing through a cord lock and/or without use of any exposed operator cord. Some embodiments may also be configured so that there is no exposed cord that a child could manipulate. Other embodiments may include one or more exposed cords, such as exposed lift cords or exposed venetian blind slat ladder cords or exposed venetian blind ladder tape.

Embodiments of the window covering 1 can include a first rail 3, a second rail 5, and window covering material 7 that is moveably attached to the first rail 3. In some embodiments, the first rail 3 can be configured as a headrail and the second rail 5 can be configured as a bottom rail. In embodiments of the window covering in which the window covering is configured as a top down bottom up shade, there may also be a third rail positioned above the first rail 3 such that the first rail is an intermediate rail and the upper third rail is a headrail. The first rail can have a length L, a width W, and a height H. The length L can be greater than the width W and can also be greater than the height H.

The second rail 5 can be connected to the window covering material 7 and/or may be coupled to the first rail 3 such that the window covering material 7 and second rail 5 are moveable relative to the first rail. The window covering material 7 can be moveable between a fully lowered, or fully extended first position, and a fully retracted, or fully raised second position. The window covering material 7 may be connected to the first rail 3 via a positional adjustment mechanism 11 so that the window covering material 7 is adjustably positioned in any number of other positions between the fully raised and fully lowered positions. The second rail 5 can also be connected to the positional adjustment mechanism to be moved relative to the first rail as the window covering material position is adjusted.

The positional adjustment mechanism 11 can be considered a height adjustment mechanism for controlling the raising and lowering of window covering material 7 for at least some embodiments of the window covering 1. The positional adjustment mechanism 11 can include a spring motor unit and lift cord collection mechanisms 31 located in the first rail 3 and/or second rail pulleys 40 located in the second rail 5. In other embodiments, the spring motor unit 12 and the lift cord collection mechanisms 31 can be located in the second rail 5 and second rail pulleys 40 can be positioned in the first rail 3. Yet other embodiments may not include any second rail pulleys 40 such as the exemplary embodiment of the window covering shown in FIG. 5.

The window covering material 7 can be any type of suitable material, such as slats on ladders, pleated material, cellular material, fabric material, non-woven fabric material, woven wood, woven bamboo, or other type of material. One or more lift cords may extend from the positional adjustment mechanism 11 located within the first rail 3 through the window covering material 7 to connect the window covering material to the positional adjustment mechanism 11. In some embodiments, the one or more lift cords may be directly connected to the window covering material. In other embodiments, the one or more lift cords may be pass through the window covering material 7 and also be connected to the second rail 5 and/or pass through the second rail 5 to facilitate a connection of the positional adjustment mechanism 11 to the window covering material 7 and the second rail 5.

Some embodiments of the window covering 1 can include a first lift cord 27 and a second lift cord 29. Other embodiments may utilize more than two lift cords. Other embodiments, may utilize only one cord that is manipulated via one or more pulleys or other mechanism to route that cord to provide two runs, or lines, to function as multiple lift cords. Each lift cord may be a cord, a segment of a cord, a tape, a polymeric filament, or other type of flexible elongated member.

The window covering 1 can be configured so that each lift cord has a first portion coupled to a spring motor unit 12 of the positional adjustment mechanism 11 positioned in the first rail 3, a second portion that passes through the window covering material 7, a third portion that is positioned in the second rail 5, a fourth portion that extends from the second rail 5 through the window covering material 7 and into the first rail 3, and a fifth portion coupled to another component of the positional adjustment mechanism 11 within the first rail. The third portion of each lift cord positioned in the second rail 5 may be entrained by or in contact with a pulley 40 within the second rail 5. Motion of the one or more lift cords can result in retraction or extension of the window covering material to raise or lower the window covering. A user may grasp the window covering material 7, the second rail 5, or a handle connected to the second rail 5 or the window covering material 7 to provide a downward force that overcome the force of the spring motor unit of the positional adjustment mechanism 11 to lower the window covering material 7 and second rail 5. This force provided by the user to lower the window covering drives motion of the lift cords to effect the lowering, or extension, of the window covering material 7 and the lowering of the second rail 5. To raise the window covering material 7 and second rail 5, a user may provide an upward force sufficient so that the force of one or more springs of the spring motor causes the lift cords to be moved to retract the window covering material 7 and second rail 5. When a user removes the force he or she has provided for raising or lowering the window covering, the positional adjustment mechanism 11 can be configured to keep the lift cords stationary after the user has removed the applied force to maintain the window covering material 7 and the second rail 5 at the user selected position of the window covering material 7 and the second rail 5.

Figure 3:
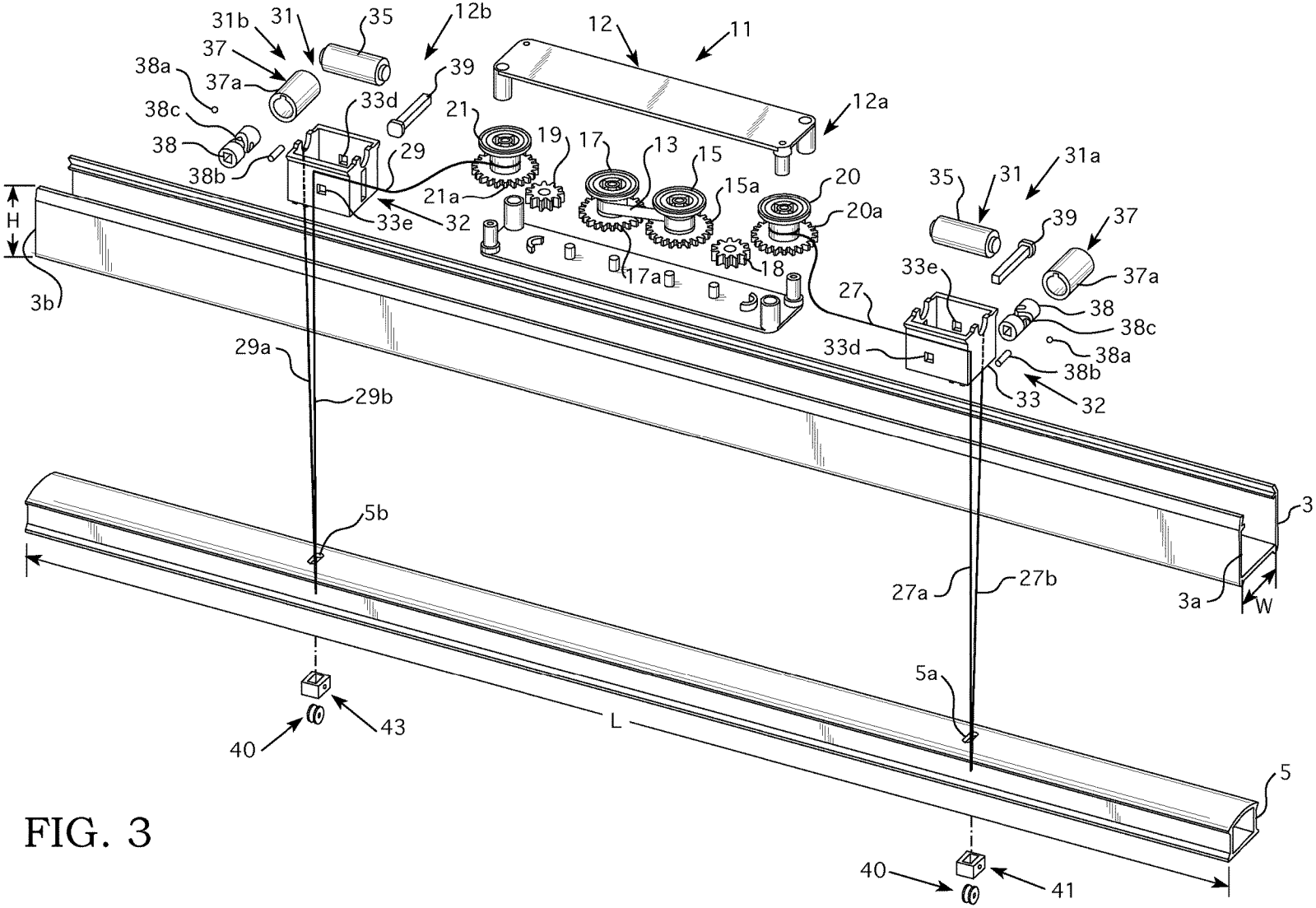
FIG. 3 is an exploded view of the first exemplary embodiment of my window covering with the window covering material cut away to better illustrate lift cord components of the window covering.
Figure 4:
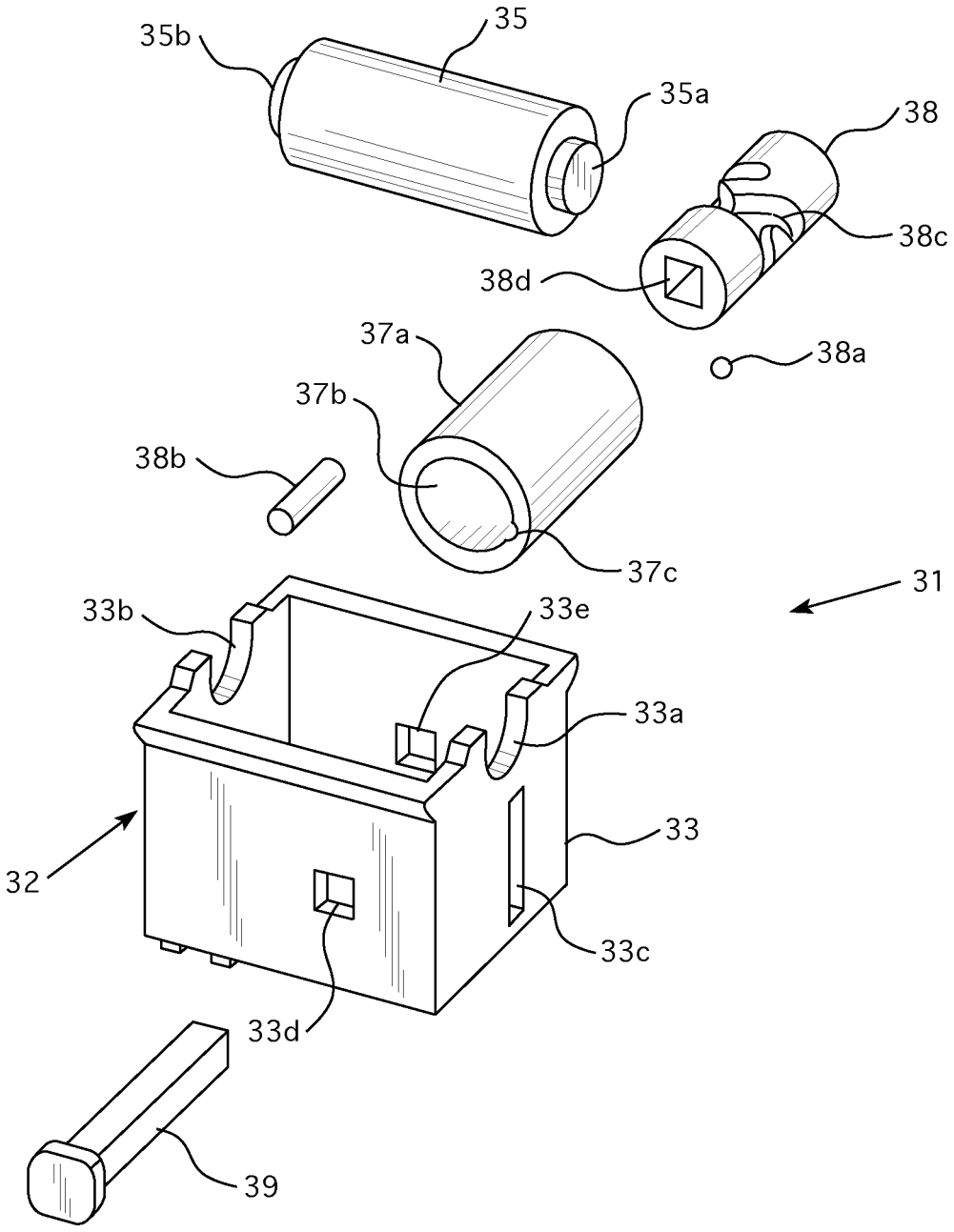
FIG. 4 is a perspective view of an exemplary component of the window covering positional adjustment mechanism that is utilized in the first and third exemplary embodiments of my window covering and includes elements used in the second exemplary embodiment as well.

Referring to FIGS. 3-4, the positional adjustment mechanism 11 can include a spring motor unit 12 and lift cord collection mechanisms 31. A first lift cord collection mechanism 31*a* can be spaced apart from a first side 12*a* of the spring motor unit 12 adjacent a first end 3*a* of the first rail 3 and a second lift cord collection mechanism 31*b* can be positioned to be spaced apart from a second side 12*b* of the spring motor unit 12 adjacent a second end 3*b* of the first rail 3 such that the first and second lift cord collection mechanisms 31*a* and 31*b* are located on opposite sides (e.g. left and right sides) of the spring motor unit 12.

The spring motor unit 12 can include a spring member 13 that extends between a first spring motor pulley 15 and a second spring motor pulley 17. A first end of the spring member 13 can be coupled to the first spring motor pulley 15 and the second end of the spring member 13 that is opposite its first end can be coupled to the second spring motor pulley 17. The first and second spring motor pulleys 15 and 17 may each have teeth that extend from a side or other portion of the pulley. The teeth 15*a* of the first spring motor pulley 15 may intermesh with the teeth 17*a* of the second spring motor pulley 17 so that both pulleys are rotatable at the same time in the same direction at the same rate of speed or substantially the same rate of speed (e.g. within 5%, within 10% or within 15% of being the same rate of speed). The intermeshing of the teeth may also add friction into the window covering material positional adjustment system of the window covering 1.

The first spring motor pulley 15 can be connected to a first lift cord pulley 20 via gear teeth 15*a* that may extend from a side of the first spring motor pulley 15 to intermesh with gear teeth 20*a* that extend from a side of the first lift cord pulley 20. Alternatively, the first lift cord pulley 15 can be connected to a first gear 18 that has teeth that intermesh with the teeth 15*a* that extend from the first spring motor pulley 15. The second spring motor pulley 17 can be connected to a second lift cord pulley 21 via gear teeth 17*a* that may extend from a side of the second spring motor pulley 17 to intermesh with gear teeth 21*a* that extend from a side of the second lift cord pulley 21. Alternatively, the second lift cord pulley 21 can be connected to a second gear 19 that has teeth that intermesh with the teeth 17*a* that extend from the second spring motor pulley 17. In yet other embodiments, the first spring motor pulley 15 can be coupled to the first lift cord pulley 20 via at least one first gear 18 positioned between the first spring motor pulley 15 and the first lift cord pulley 20 that is coupled between those pulleys via intermeshing gear teeth and/or other attachment mechanisms. The second spring motor pulley 17 can also be coupled to the second lift cord pulley 21 via at least one second gear 19 positioned between the second spring motor pulley 17 and the second lift cord pulley 21 that is coupled between those pulleys via intermeshing gear teeth and/or other attachment mechanisms.

In some embodiments, the first and second gears 18 and 19 can be configured to provide a pre-selected gear ratio so that the length of the spring member 13 can shorter for facilitating positional adjustment of longer sized window covering material 7 and/or to facilitate the addition of friction into the positional adjustment system to help accommodate precision in the maintaining of the window covering material in a user selected position between the extended and retracted positions. In yet other embodiments, multiple intermeshed gears may be positioned between a spring motor pulley and a lift cord pulley to provide a desired gear ratio and frictional operational parameter to an embodiment of a window covering for transmission of the motion of the spring motor pulleys driven by motion of the spring member 13 to the lift cords to meet a particular set of design criteria.

The first lift cord pulley 20 may have a first end of a first lift cord 27 attached thereto such that the first lift cord 27 is windable about the first lift cord pulley 20 when the first lift cord pulley 20 rotates in the first rotational direction and is unwindable from the first lift cord pulley 20 via rotation of the pulley in the second rotational direction. The second lift cord pulley 21 may have a first end of a second lift cord 29 attached thereto such that the second lift cord 29 is windable about the second lift cord pulley 21 when the pulley is rotated in the first rotational direction and is unwindable from the second lift cord pulley 21 via rotation of the pulley in the second rotational direction.

The first lift cord 27 can extend from the first lift cord pulley 20, through the window covering material 7 to a pulley 40 in the second rail 5, such as a first second rail pulley 41 located entirely within the second rail 5, and may then extend from the second rail 5 back through the window covering material 7 to return to the first rail. A second end of the first lift cord 27 may be connected to a pulley of the first lift cord collection mechanism 31*a* within the first rail 3. The second lift cord 29 can extend from the second lift cord pulley 21, through the window covering material 7 to a pulley 40 in the second rail 5, such as a second second rail pulley 43 located entirely within the second rail 5, and may then extend from the second rail 5 back through the window covering material 7 to return to the first rail 3. A second end of the second lift cord 29 may be connected to a pulley of the second lift cord collection mechanism 31*b* within the first rail 3. The second rail 5 may have at least one first opening 5*a* formed therein to permit the first lift cord 27 to extend into the second rail 5 for entrainment about the first second rail pulley 41 and passing out of the second rail 5 toward the window covering material 7 and first rail 3 such that first and second segments 27*a* and 27*b* of the first lift cord 27 vertically extend through the window covering material between the first rail 3 and the second rail 5. The second rail 5 may have at least one second opening 5*b* formed therein to permit the second lift cord 29 to extend into the second rail 5 for entrainment about the second second rail pulley 43 and passing out of the second rail 5 toward the window covering material 7 and first rail 3 such that first and second segments 29*a* and 29*b* of the second lift cord 29 vertically extend through the window covering material 7 between the first rail 3 and the second rail 5.

Rotation of the second spring motor pulley 17 and/or first spring motor pulley 15 driven by motion of the spring member 13 about the first and second spring motor pulleys 15 and 17 can drive the rotation of the first lift cord pulley 20 and the second lift cord pulley 21 via the intermeshing teeth and/or other connection between the spring motor unit 12 and those lift cord pulleys. In some embodiments, rotation of the first lift cord pulley 20 and rotation of the second lift cord pulley 21 may be driven by a user providing a force for lowering the window covering 1 and this user applied force can also drive rotation of the first and second spring motor pulleys 15 and 17 via the connection between the first lift cord pulley 20 and the first spring motor pulley 15 and the connection between the second lift cord pulley 21 and the second spring motor pulley 17. The user applied force may have to be greater than the counterbalance force provided by the spring member 13 to effect such a motion of the spring motor pulleys and lift cord pulleys.

The first and second lift cord pulleys 20 and 21 and the first and second spring motor pulleys 15 and 17 can be configured so that they all rotate in the same first rotational direction during raising of the window covering material and may all rotate in the same second rotational direction that is opposite this first rotational direction during lowering of the window covering material. For instance, the spring member 13 can be coupled to the first and second spring motor pulleys 15 and 17 such that the spring member 13 is biased to move in a first direction to be wound upon one of the first spring motor pulley 15 and the second spring motor pulley 17 such that this motion of the spring member 13 results in the first and second spring motor pulleys 15 and 17 rotating in a first rotational direction (e.g. clockwise or counterclockwise). When a user exerts a force to lower the window covering material 7, the force may overcome the spring member biasing force to cause the spring member 13 to unwind from the spring motor pulley to which it is biased to wind upon and wind upon the other spring motor pulley by the user force causing rotation of the lift cords to extend further from the first rail to drive rotation of the first and second lift cord pulleys 20 and 21 in a second rotational direction that is opposite the first rotational direction (e.g. the second rotational direction is clockwise if the first rotational direction is counterclockwise, the second rotational direction is counterclockwise if the first rotational direction is clockwise, etc.). This motion of the lift cord pulleys can cause the first and second spring motor pulleys 15 and 17 to rotate in the second rotational direction via the interconnection of the lift cord pulleys to the spring motor pulleys (e.g. via the intermeshing gear connection between the first lift cord pulley 20 and the first spring motor pulley 15 and the intermeshing gear connection between the second lift cord pulley 21 and the second spring motor pulley 17). This rotational motion of the spring motor pulleys may also cause the spring member to move so that the spring member unwinds from one spring motor pulley and is further wound upon the other spring motor pulley.

For instance, if the spring member 13 is configured to wind upon the second spring motor pulley 17 to provide a force for raising the window covering and/or maintaining a position of the window covering material, the user exerted force to lower the window covering material may cause the spring member 13 to unwind from the second spring motor pulley 17 and wind upon the first spring motor pulley 15. As another example, if the spring member 13 is configured to wind upon the first spring motor pulley 15 to provide a force for raising the window covering and/or maintaining a position of the window covering material, the user exerted force to lower the window covering material 7 may cause the spring member 13 to unwind from the first spring motor pulley 15 and wind further upon the second spring motor pulley 17 in response to the lowering of the window covering material 7.

The spring motor unit 12 may be retained within a housing located within a channel or cavity of the first rail. The first and second lift cord pulleys and/or first and second gears 18 and 19 can also be positioned in this housing located within the first rail 3. The housing of the spring motor unit 12 may have posts or other type of axles or may have axles attached therein that define axes of rotation for the first and second spring motor pulleys 15 and 17 and also for the first and second lift cord pulleys 20 and 21 and, if present, also for any gears that may be positioned between those pulleys.

The positional adjustment mechanism 11 can also include lift cord collection mechanisms 31 positioned in the first rail 3 or positioned adjacent the first rail 3. For instance, the first lift cord collection mechanism 31*a* can be within the first rail 3 such that it is located within the first rail 3 so that the first lift cord pulley 20 is between the first lift cord collection mechanism 31*a* and the first spring motor pulley 15. The second lift cord collection mechanism 31*b* can be positioned in the first rail 3 so that the second lift cord pulley 21 is between the second lift cord collection mechanism 31*b* and the second spring motor pulley 17.

Each lift cord collection mechanism 31 can include a housing 32 that is positionable in the first rail 3 that is coupled to a second roller 35 and a first roller 37. The housing may be coupled to these rollers such that the length of the second roller 35 may be considered to extend along its length such that its length extends along the length L of the first rail 3 and the first roller 37 can be considered to have its length extend along the width W of the first rail 3. Such an arrangement of the first and second rollers 37 and 35 can be configured so that the axis about which the second roller 35 rotates is perpendicular or is substantially perpendicular (e.g. within 10° of being perpendicular) to the axis about which the second roller rotates. Other configurations of the first and second rollers 37 and 35 that orient the first and second rollers 37 and 35 differently are also possible to meet a particular set of design criteria.

The housing 32 of each lift cord collection mechanism 31 can have a plurality of openings defined therein for attachment of different components and to permit a lift cord to pass into and out of the housing. Each lift cord collection mechanism 31 can also include a second roller 35 and a first roller 37. Each roller can be configured so that a lift cord may be entrained about or passed along a surface of that roller. The second roller 35 can have a first end 35*a* and a second end 35*b*. These end portions of the second roller 35 may be projections or protuberances in some embodiments. The first end 35*a* can be sized to be received and retained within a first upper opening 33*a* formed in the upper part of the housing in a first side of the housing 32 and the second end 35*b* can be sized to be received and retained within a second upper opening 33*b* formed in the upper part of the housing in a second side of the housing 32 that is opposite the first side of the housing. The second roller 35 can be rotatable in a first direction and in a second direction that is opposite the first direction. In other embodiments, the second roller 35 can be a tubular structure that has an axle positioned therein to extend from the first upper opening 33*a* to the second upper opening 33*b* to form an axle that defines the axis of rotation for the second roller 35.

The housing 32 of each cord collection mechanism 31 can also include a lift cord aperture 33*c* in the first side of the housing 32 below the first opening 33*a* or formed in the second side of the housing that is below the second opening 33*b*. For example, the lift cord aperture 33*c* of the first lift cord collection mechanism 31*a* is formed in the second side below the second opening 33*b* and the lift cord aperture 33*c* of the second lift cord collection mechanism 31*b* is formed in the first side of the housing 32 below the first opening 33*a*.

The lift cord aperture 33*c* can be sized and configured to permit the first lift cord 27 or the second lift cord 29 to pass into the housing. The housing 32 of each lift cord collection mechanism 31 may also have a first hole 33*d* defined in a third side of the housing that is located between the first and second sides of the housing. In some embodiments, the third side of the housing may extend between the first and second sides of the housing. The housing can also have a fourth side that is opposite the third side that extends between the first and second sides of the housing. The fourth side may have a second hole 33*e* that is aligned with the first hole 33*d* defined in the third side of the housing 32. The housing 32 may also have a bottom that is attached to the lower ends of the first, second, third, and fourth sides of the housing. The bottom may have one or more apertures (e.g. at least one slot, at least one hole, etc.) Alternatively, the housing 32 may not include such a bottom side.

The first roller 37 can include a first tubular outer roller body 37*a* that has a central channel 37*b* and a groove 37*c* within the body that is in communication with the central channel 37*b*. The external outer surface of the first tubular outer roller body 37*a* can be configured to contact a lift cord for entrainment of the lift cord and/or so that the lift cord can pass along the first roller 37. The first roller 37 also includes a second inner tubular body 38 that has an inner channel 38*d* that is sized to receive a shaft 39 so that the shaft 39 can be passed through the second tubular body such that the shaft 39 can extend from the first hole 33*d*, through the second inner tubular body 38, and to and/or through the second hole 33*e* to suspend the first roller within the housing and define an axis of rotation about which the first tubular body 37*a* is rotatable in first and second rotational directions (e.g. clockwise and counterclockwise directions, forwardly and backwardly rotational directions, etc.). The inner channel 38*d* can be shaped to matingly receive the shaft 39 such that the second tubular body 38 does not rotate or move about the shaft 39 such that the first tubular outer roller body 37*a* is rotatable relative to the shaft 39 and the second inner tubular body 38. For instance, the inner channel 38*d* can have a polygonal shape that corresponds to a polygonal cross sectional shape of the shaft 39 in some embodiments so that the shaft 39 matingly interlocks with the second inner tubular body 38. The first and second holes 33*d* and 33*e* may also have corresponding polygonal shapes to matingly receive portions of the shaft 39 for attaching the shaft 39 to the housing for coupling the first roller 37 to the housing. The first and second holes 33*d* and 33*e* may be positioned below the first and second upper openings 33*a* and 33*b* so that the first roller 37 is located below the second roller 35.

The second inner tubular body 38 can have a groove 38*c* formed along an outer surface of the body. In some embodiments, the groove 38*c* may be defined so that it is spaced apart from the inner channel 38*d* and is not in communication with the inner channel 38*d*. The groove 38*c* can have different segments of different depth within the outer surface of the second inner tubular body 38 so that a ball 38*a* that rolls or otherwise moves within the groove may extend a different distance out of the groove 38*c* at different locations along the groove 38*c* as the ball rolls or moves along the groove 38*c*. In some embodiments, the groove 38*c* can be configured to define a path of travel for a ball 38*a* or other type of moveable body that may move along the groove 38*c* between the second inner body 38 and the first outer tubular body 37*a* within the central channel 37*b* of the first outer tubular body 37*a*. In some embodiments, the groove 38*c* may define a path that is curved about a helically shaped path that extends along the outer surface of the second inner tubular body 38. The ball 38*a* may be a spherical shaped body or other rounded body that may roll along the groove 38*c* in the central channel 37*b* between the second inner tubular body 38 and the interior surface of the first outer tubular body 37*a* that defines the central channel 37*b*.

A rod 38*b* can also be positioned in the central channel 37*b* between the inner surface of the first outer tubular body 37*a* and the second inner tubular body 38. The rod 38*b* may have a cylindrical body such as a solid cylindrical body or a tubular cylindrical body. The rod 38*b* can be positioned within a groove 37*c* define in the interior surface of the first outer tubular body 37*a* that is in communication with the central channel 37*b*. The rod 38*b* can be configured to contact the ball 38*a* during rotation of the first outer tubular body 37*a* relative to the second inner tubular body 38 to drive motion of the ball 38*a* along the groove 38*c*.

The path of motion for ball 38*a* defined by the groove 38*c* can be configured so that when the first outer tubular body 37*a* rotates in a first rotational direction relative to the second inner tubular body 38, which can be a direction of rotation of the first outer tubular body 37*a* that occurs during the extension of window covering material 7 (e.g. lowering of window covering material), the first outer tubular body 37*a* is not impeded from rotation at any time by the ball 38*a* directly contacting or engaging the rod 38*b*. The rotational motion of the first outer tubular body 37*a* during extension of the window covering material can correspond with the motion of the lift cord entrained about the first roller 37 that occurs during extension of the window covering material.

The path defined by the groove 38*c* can also be configured so that when the first outer tubular body 37*a* is rotated in a second rotational direction that is opposite this first rotational direction and may correspond to the direction of rotation of the first outer tubular body 37*a* that occurs during the raising of the window covering material 7, the first outer tubular body 37*a* is able to rotate for a maximum distance or a maximum number of revolutions (e.g. one full revolution, up to 3 full revolutions, no more than five full revolutions, no more than half a revolution, etc.) before the ball 38*a* is stopped in a terminal end of the groove 38*c* and the rod 38*b* contacts the ball 38*a* or otherwise engages the ball 38*a* to bind the first outer tubular body 37*a* to the second inner tubular body 38 to prevent further rotation of the first outer tubular body 37*a* so that the first roller 37 is only able to rotate a limited amount in the second rotational direction. In some embodiments, the depth of the groove 38*c* may be configured to change so that the ball 38*a* is positioned in a shallow section of the groove 38*c* when the first outer tubular body 37*a* is rotated in the second direction such that the ball 38*a* contacts the rod 38*b* sufficiently to bind with the rod 38*b* for preventing further rotation of the first outer tubular body 37*a* relative to the stationary second inner tubular body 38 at the shallow terminal end of the groove 38*c*. The groove 38*c* can also be configured so that the ball 38*a* is positioned via contact with the rod 38*a* during rotation of the outer tubular body 37*a* in the first rotational direction to move along the path defined by the groove 38*c* from the first shallow terminal end along the groove 38*c* to one or more deeper sections of the groove that position the ball 38*a* to permit the rod 38*b* to contact the ball 38*a* while also passing over the ball 38*a* or along the ball 38*a* when the ball 38*a* reaches a deeper second terminal end of the groove that is deeper than the shallower first end of the groove such that the first outer tubular body 37*a* is always able to rotate any number of revolutions or any desired distance in the first rotational direction even after the ball 38*a* is located in the second deeper terminal end of the groove 38*c* via the motion of the rod 38*b*.

In other embodiments, the first outer tubular body 37*a*, second inner tubular body 38, ball 38*a*, rob 38*b* and groove 38*c* can be arranged so that the ball 38*a* moves along the groove 38*c* such that binding engagement between the rod 38*b* and ball 38*a* occur only when the outer tubular body 37*a* is rotated in the second rotational direction instead of the first rotational direction. For instance, the path of motion for ball 38*a* defined by the groove 38*c* can be configured so that when the first outer tubular body 37*a* rotates in a first rotational direction relative to the second inner tubular body 38, which can be a direction of rotation of the first outer tubular body 37*a* that occurs during the raising of window covering material 7, the first outer tubular body 37*a* is not impeded from rotation at any time by the ball 38*a* directly contacting or engaging the rod 38*b*. The path defined by the groove 38*c* can also be configured so that when the first outer tubular body 37*a* is rotated in a second rotational direction that is opposite this first rotational direction and may correspond to the direction of rotation of the first outer tubular body 37*a* that occurs during the lowering of the window covering material 7, the first outer tubular body 37*a* is able to rotate for a maximum distance or a maximum number of revolutions (e.g. one full revolution, up to 3 full revolutions, no more than five full revolutions, no more than half a revolution, etc.) before the ball 38*a* is stopped in a terminal end of the groove 38*c* and the rod 38*b* contacts the ball 38*a* or otherwise engages the ball 38*a* to bind the first outer tubular body 37*a* to the second inner tubular body 38 to prevent further rotation of the first outer tubular body 37*a* so that the first roller 37 is only able to rotate a limited amount in the second rotational direction. The second rotational direction can correspond to a direction of motion of the lift cord entrained about the first roller 37 moves when the window covering material 7 is being retracted.

Each lift cord collection mechanism 31 can be configured so that at least one lift cord extends from a lift cord pulley coupled to the spring motor unit 12 to the second roller to pass along the outer surface of the first outer tubular body 37*a* of the first roller 37 and subsequently pass out of the housing and the first rail 3 and into the window covering material 7. A first segment of the lift cord may then extend through the window covering material and into the second rail. The lift cord may then wrap around a pulley 40 in the second rail, and subsequently pass out of the second rail 5 back into the window covering material. A second segment of the lift cord may then pass through the window covering material to the first rail 3 parallel or substantially parallel to the first segment of the lift cord. The lift cord may then enter the first rail and the housing of the lift cord collection mechanism and wrap around or wind around the second roller 35. A terminal end of the lift cord may be coupled to the second roller 35 and the opposite terminal end of the lift cord may be coupled to the lift cord pulley from which it extends so that the lift cord can be wound upon the second roller 35 during raising of the window covering material and unwound from the second roller 35 during lowering of the window covering material. Alternatively, the lift cord may be coupled between the second roller 35 and the lift cord pulley from which it extends at its opposite terminal ends such that the lift cord can be unwound from the second roller 35 during raising of the window covering material and wound upon the second roller 35 during lowering of the window covering material.

In some embodiments, the lift cord may be coupled between the second roller 35 and lift cord pulley to which it is attached so that the lift cord may wind about the second roller 35 at a different rate of accumulation as compared to the rate at which it is unwound the lift cord pulley. For example, it is contemplated that the lift cord can be configured to wind upon the second roller 35 at one rate of winding while being unwound upon the lift cord pulley at another rate of unwinding to effect a lengthening of vertically extending segments of that lift cord that extend between the first and second rails 3 and 5 to provide for a lowering, or extending, of the window covering material. As another example, it is contemplated that the lift cord can be configured to unwind upon the second roller 35 at one rate of unwinding while being wound upon the lift cord pulley at another rate of winding to effect a lengthening of vertically extending segments of that lift cord that extend between the first and second rails 3 and 5 to provide for a lowering, or extending, of the window covering material.

This differential rate may also occur to effect raising of the window covering material such that the rate at which the lift cord is unwound upon the second roller 35 may differ from the rate that the lift cord is wound upon the lift cord pulley to which it is attached during raising of the window covering material. For example, it is contemplated that the lift cord can be configured to be wound upon the second roller 35 at one rate of winding while being unwound upon the lift cord pulley at another rate of unwinding to effect a shortening of the vertically extending segments of that lift cord that extend between the first and second rails 3 and 5 to provide for retracting, or raising, the window covering material. As another example, the lift cord can be configured to be unwound upon the second roller 35 at one rate of unwinding while being wound upon the lift cord pulley at another rate of winding to effect a shortening of the vertically extending segments of that lift cord that extend between the first and second rails 3 and 5 to provide for retracting, or raising, the window covering material.

For instance, referring to FIG. 3, the first lift cord 27 can have a first terminal end connected to the first lift cord pulley 20 and a second terminal end connected to the second roller 35 of the first lift cord collection mechanism 31*a*. A first portion of the first lift cord 27 can be wound upon the first lift cord pulley 20. A second portion of the first lift cord 27 may extend from the first lift cord pulley 20 through the first lift cord aperture 33*c* facing toward the first lift cord pulley 20 and into the housing 32 of the first lift cord collection mechanism 31*a* to the first roller 37 of the first lift cord control mechanism 31*a*. A third portion of the first lift cord 27 can pass over the first roller 37 via contacting the first roller 37 to change direction from a horizontal direction to a vertical direction for passing out of the first rail 3 and housing 32 of the lift cord collection mechanism and into the window covering material 7. A fourth portion of the first lift cord 27 may extend through the window covering material 7 from the first rail 3 to the second rail 5. This fourth portion of the first lift cord 27 may be a first vertically extending segment 27*a* of the first lift cord 27 that extends between the first and second rails 3 and 5. A fifth portion of the first lift cord 27 may extend through a first opening 5*a* in the second rail 5, pass along a first second rail pulley 41 in the second rail 5, and extend from the first second rail pulley 41 out of the first opening 5*a*. It should be understood that the fifth portion of the first lift cord 27 within the second rail 5 may have two vertically extending segments, one extending from the first opening 5*a* to the first second rail pulley 41 and a second vertically extending segment extending form the first second rail pulley 41 to the first opening 5*a*. A sixth portion of the first lift cord 27 may extend through the window covering material 7 between the second rail 5 and the first rail 3. This sixth portion of the first lift cord may be a second vertically extending segment 27*b* of the first lift cord 27 that extends parallel to or substantially parallel to the first segment 27*a*. A seventh portion of the first lift cord may extend form the first rail 3 through the housing 32 and around the second roller 35 to its second terminal end of the first lift cord 27 attached to the second roller 35. When the window covering material 7 is lowered, the first lift cord 27 may be unwound from the first lift cord pulley 20 and have a further amount of the lift cord extend from the first lift cord pulley 20 as it is unwound from the first lift cord pulley 20 and pass over the first roller 37 as the first lift cord 27 is extended out of the first rail 3 during lowering of the window covering material such that the first roller 37 rotates in a first direction as the lift cord is moved. A portion of the lift cord may also move along the first second rail pulley 41 as the window covering material 7 is lowered so that the first and second segments 27*a* and 27*b* increase in length as the second rail is lowered and the window covering material is more fully extended during lowering of the window covering material 7. It is contemplated that the second roller 35 of the first lift cord collection mechanism 31*a* may also rotate during lowering of the window covering material 7 to collect a portion of the first lift cord during the lowering of the window covering material 7. Alternatively, it is contemplated that the second roller 35 may not substantively rotate during the lowering of the window covering material 7.

When the window covering material 7 is raised, the first lift cord 27 may be wound upon the first lift cord pulley 20 such that the length of the first and second segments 27*a* and 27*b* shorten. A portion of the first lift cord 27 may move along the first second rail pulley 41 during the raising of the window covering material 7 that results in shortening of the length of the first and second segments 27*a* and 27*b* of the first lift cord 27. The portion of the first lift cord that is retracted back into the first rail 3 for winding upon the first lift cord pulley 20 during raising of the window covering may also pass along the first roller 37 as it moves from first rail for winding upon the first lift cord pulley 20. The first roller 37 may rotate initially during the raising of the window covering material in a rotational direction that is opposite the direction it rotates during the lowering of the window covering material for a pre-selected maximum amount of revolutions or distance (e.g. 1 revolution, 3 revolutions, not more than 5 revolutions, etc.). Thereafter, the ball 38*a* may bind against the rod 38*b* as the ball 38*a* is moved within the groove 38*c* such that further rotation of the first roller 37 is prevented. This can increase the friction imparted as the lift cord is moved along the first roller 37 to improve the precision of the spring member 13 facilitating a maintaining of the position of the window covering material after a user stops providing an upward force to stop adjustment of the raising of the window covering material 7.

The second lift cord 29 may be routed to pass through the first rail 3, window covering material 7 and second rail 5 in a manner similar to the first lift cord 27. For instance, the second lift cord 29 can have its first terminal end connected to the second lift cord pulley 21 and its second terminal end connected to the second roller 35 of the second lift cord collection mechanism 31*b*. A first portion of the second lift cord 29 can be wound upon the second lift cord pulley 21. A second portion of the second lift cord 29 may extend from the second lift cord pulley 21 through the first lift cord aperture 33*c* facing toward the second lift cord pulley 21 and into the housing 32 of the second lift cord collection mechanism 31*b* to the first roller 37 of the second lift cord control mechanism 31*b*. A third portion of the second lift cord 29 can pass over the first roller 37 of the second lift cord collection mechanism 31*b* via contacting the first roller 37 to change direction from a horizontal direction to a vertical direction for passing out of the first rail 3 and housing 32 of the lift cord collection mechanism and into the window covering material 7. A fourth portion of the second lift cord 29 may extend through the window covering material 7 from the first rail 3 to the second rail 5. This fourth portion of the second lift cord 29 may be a first vertically extending segment 29*a* of the lift cord that extends vertically between the first and second rails 3 and 5. A fifth portion of the second lift cord 29 may extend through a second opening 5*b* in the second rail 5, pass along a second second rail pulley 43 in the second rail 5, and extend from the second second rail pulley 43 out of the second opening 5*b*. It should be understood that the fifth portion of the second lift cord 29 within the second rail 5 may have two vertically extending segments, one extending from the second opening 5*b* to the second second rail pulley 43 and a second vertically extending segment extending form the second second rail pulley 43 to the second opening 5*b*. A sixth portion of the second lift cord 29 may extend through the window covering material 7 between the second rail 5 and the first rail 3. This sixth portion of the second lift cord may 29 be a second vertically extending segment 29*b* of the second lift cord 29 that extends parallel to or substantially parallel to the second segment 29*a*. A seventh portion of the second lift cord 29 may extend form the first rail 3 through the housing 32 of the second lift cord collection mechanism 31*b* and around the second roller 35 to its second terminal end of the second lift cord 29 attached to the second roller 35 of the second lift cord collection mechanism 31*b*. When the window covering material 7 is lowered, the second lift cord 29 may be unwound from the second lift cord pulley 21 and have a further amount of the lift cord extend from the second lift cord pulley 21 as it is unwound from the second lift cord pulley 21 and pass over the first roller 37 as the lift cord is extended out of the first rail 3 during lowering of the window covering material such that the first roller 37 rotates in a first direction as the lift cord is moved during extension of the window covering material. A portion of the second lift cord 29 may also move along the second second rail pulley 43 as the window covering material 7 is lowered so that the first and second segments 29*a* and 29*b* of the second lift cord 29 increase in length as the second rail 5 is lowered and the window covering material 7 is more fully extended during lowering of the window covering material 7. It is contemplated that the second roller 35 of the second lift cord collection mechanism 31*b* may also rotate during lowering of the window covering material to collect a portion of the second lift cord 29 during the lowering of the window covering material 7. Alternatively, it is contemplated that the second roller 35 may not substantively rotate during the lowering of the window covering material 7.

When the window covering material 7 is raised, the second lift cord 29 may be wound upon the second lift cord pulley 21 such that the length of the first and second segments 29*a* and 29*b* shorten during raising of the window covering material 7. A portion of the second lift cord 29 may move along the second second rail pulley 43 during the raising of the window covering material 7 that results in shortening of the length of the first and second segments 29*a* and 29*b* of the second lift cord 29. The portion of the second lift cord 29 that is retracted back into the first rail 3 for winding upon the second lift cord pulley 21 during raising of the window covering may also pass along the first roller 37 as it moves from first rail 3 for winding upon the second lift cord pulley 21. The first roller 37 of the second lift cord collection mechanism 31*b* may rotate initially during the raising of the window covering material in a rotational direction that is opposite the direction it rotates during the lowering of the window covering material 7 for a pre-selected maximum number of revolutions (e.g. 0.25 revolutions, 0.5 revolutions, 1 revolution, 3 revolutions, 5 revolutions, etc.) or distance. Thereafter, the ball 38*a* of the first roller 37 may bind against the rod 38*b* as the ball 38*a* is moved within the groove 38*c* such that further rotation of the first roller 37 is prevented. This can increase the friction imparted as the second lift cord 29 is moved along the first roller 37 to improve the precision of the spring member 13 facilitating a maintaining of the position of the window covering material 7 after a user stops providing an upward force to stop adjustment of the raising of the window covering material 7.

Alternatively, when the window covering material 7 is lowered, the first and second lift cords 27 and 29 may be configured to unwind from the second rollers 35 of the lift cord collection mechanisms 31 to which they are attached and wind upon these second rollers 35 when the window covering material 7 is raised. The cord path of the first and second lift cords may be the same, but their direction of motion may be altered for opposite motion by such an embodiment. For instance, in such an alternative configuration, the first and second lift cord pulleys 20 and 21 may not rotate during the lowering of the window covering or may rotate to collect a portion of the lift cords as the window covering material is lowered and may also rotate when the lift cords are moved to further wind upon the second roller 35 during raising of the window covering material 7. The first rollers 37 for such a configuration may be configured to freely rotate during lowering of the window covering material and may be configured to only rotate up to a pre-selected maximum number of revolutions (or distance) prior to stopping rotation in an opposite rotational direction during raising of the window covering as the lift cords move during retraction such that they are further wound upon the first rollers for collection therein during raising of the window covering material 7.

In some embodiments, the lift cord collection mechanisms 31 can be configured to help provide tension during the raising of the window covering material by being configured so that the rotation of the first rollers 37 via rotation of the first outer tubular roller body 37*a* in each lift cord collection mechanism is prevented after the raising of the window covering material is initiated (e.g. after a short distance of raising of the window covering material 7) to increase the friction applied to the lift cords. The increased friction provided by the non-rotatable first roller 37 during raising of the window covering material 7 can help facilitate an increased precision in height adjustment by helping the spring member 13 provide a force sufficient to keep the window covering material 7 maintained at a new user selected location immediately after a user stops providing the upward force for facilitating the raising of the window covering material 7. Further, the first rollers 37 can be configured to always rotate in the opposite direction of rotation of the roller that occurs when the window covering material is lowered. The configuration of the first roller 37 can help ensure that friction incurred by motion of the lift cords is reduced for lowering of the window covering material while increasing friction incurred by motion of the lift cord during raising of the window covering material.

In other embodiments, the lift cord collection mechanisms 31 can be configured to help provide tension during the lowering of the window covering material by being configured so that the rotation of the first rollers 37 via rotation of the first outer tubular roller body 37*a* in each lift cord collection mechanism is prevented after the lowering of the window covering material is initiated (e.g. after a short distance of raising of the window covering material 7) to increase the friction applied to the lift cords. The increased friction provided by the non-rotatable first roller 37 during lowering of the window covering material 7 can help facilitate an increased precision in height adjustment by helping the spring member 13 provide a force sufficient to keep the window covering material 7 maintained at a new user selected location immediately after a user stops providing the downward force for facilitating the raising of the window covering material 7. Further, the first rollers 37 can be configured to always rotate in the opposite direction of rotation of the roller that occurs when the window covering material is raised. The configuration of the first roller 37 can help ensure that friction incurred by motion of the lift cords is reduced for raising of the window covering material while increasing friction incurred by motion of the lift cord during lowering of the window covering material. Embodiments in which increased tension is provided during lowering of window covering material 7 may be of particular use when the spring motor unit 12 and lift cord collection mechanisms 31 are located in a bottom rail and the second rail pulleys 40 are located in an upper rail (e.g. an intermediate rail or a head rail).

The first roller 37 of each lift cord collection mechanism 31 can have other configurations to provide increased friction that applies to a lift cord entrained about the outer surface of the first roller 37 when the lift cord moves during retraction of window covering material and freely rotates to provide a lesser amount of friction on the lift cord entrained about that roller 37 when the lift cord moves during extension of window covering material 7. For instance, referring to FIGS. 7-10, each first roller 37 can include a first outer roller body 37*a* that has a central channel 37*b* that receives a second inner tubular body 38 that is configured as a gear-type body having a profile that defines a plurality of teeth 38*e*. Each of the teeth 38*e* can be configured so that a portion 38*f* of the outer body of the second inner tubular body 38 is curved from a distal point of a tooth to the distal point of an immediately adjacent tooth. Each curved portion 38*f* can be defined or structured to define a shape in the exterior surface of the second inner tubular body 38 that may be considered a groove, furrow, or other type of recess defined in the outer surface of the second inner tubular body 38 to shape the teeth of the inner tubular body 38.

The first outer tubular body may have a plurality of slots 37*d* defined therein. Each slot 37*d* can be configured to receive a ball 38*a* so that the ball 38*a* can be positioned between teeth 38*e* of the second inner tubular body 38 and the first outer tubular body 37*a*. Each slot 37*d* can be defined to have a shape that permits the ball 38*a* to move within the slot in multiple directions. The depth or orientation to define a path of motion for all the balls 38*a* or just one ball 38*a* that is to always be located within a respective one of the slots 37*d*. For this configuration of the first roller 37, the first and second tubular bodies 37*a* and 38 are configured to permit the first roller 37 to rotate freely in one direction that corresponds to extending of window covering material 7 and only rotate a pre-selected number of rotations or a pre-selected number of revolutions (e.g. 0.1 revolutions, 0.2 revolutions, 0.5 revolutions, etc.) in a direction that corresponds to the retraction of window covering material 7.

For example, the slots 37*d* defined by the first outer tubular body 37*a* can be shaped so that during rotation in a first rotational direction the balls 38*a* move along one slot 37*d* from a first end of the slot to a second end of the slot 37*d* between immediately adjacent teeth of the second inner tubular body along the curved portion of the exterior surface of the second inner tubular body that extends between the distal points of the teeth 38*e* as the first outer tubular body 37*a* is rotated during motion of the lift cord that occurs when the window covering material 7 is extended. The slot 37*d* and shape of the teeth 38*e* and portions 38*f* can be configured so that each ball is driven by the rotation of the first outer tubular body 37*a* so that it moves from the first end of the slot to the second end of the slot 37*d* until it reaches the second end of that slot. The slot depth and curvature of the teeth and portions 38*f* can be configured so that the ball 38*a* is held in the second end as the first outer tubular body 37*a* rotates about the second inner tubular body 38 such that the balls 38*a* and outer tubular body 37*a* are able to freely rotate about the second inner tubular body 38. In some embodiments the depth of the slots 37*d* and their configuration are provided so that the balls 38*a* each stay at the second end of the slot 37*d* retaining that ball as the first outer tubular body 37*a* rotates. In other embodiments, the slots 37*d* can be configured to each be in communication with each other so that each ball 38*a* can be moved from the second end of the slot 37*d* to an immediately adjacent slot 37*d* so that the ball 38*a* is able to pass from one slot to another slot during rotation of the first outer tubular body 37*a* relative to the second inner tubular body 38 when the outer tubular body is rotated during extension of the window covering material. For such embodiments, each ball 38*a* may move along a path defined by the plurality of slots 37*d* that are arranged around the second inner tubular body 38 so that the balls 38*a* move along this path by passing into and through each of the slots 37*d* as the first outer tubular body freely rotates during the extension of the window covering material 7.

The slots 37*d* may be shaped in conjunction with the shaping of the outer surface of the second inner tubular body 38 so that when the first outer tubular body 37*a* rotates in another rotational direction that corresponds with the motion of the lift cord entrained about that body that occurs during retraction of window covering material, the first outer tubular body 37*a* rotates a pre-selected number of revolutions (or a pre-selected number of rotations) until each ball 38*a* is at a first end of a respective one of the slots 37*d* (e.g. a first ball is in the first end of a first slot, a second ball is in the first end of a second slot, a third ball is in the first end of a third slot, the fourth ball is in the first end of the fourth slot, etc.). The shape of the first end and the teeth 38*e* and/or the curved portions 38*f* can be configured so that once each ball 38*a* is at the first end of a respective one of the slots 37*d*, the balls 38*a* bind against a respective distal point of a respective one of the teeth of the second inner tubular body 38 to prevent further rotation of the first outer tubular body 37*a* relative to the second inner tubular body 38 during retraction of the window covering material. Such a configuration can prevent further rotation of the first roller 37 in the rotational direction that corresponds with retraction of window covering to provide an increased friction on the motion of the lift cord entrained about the first roller 37.

Figure 5:
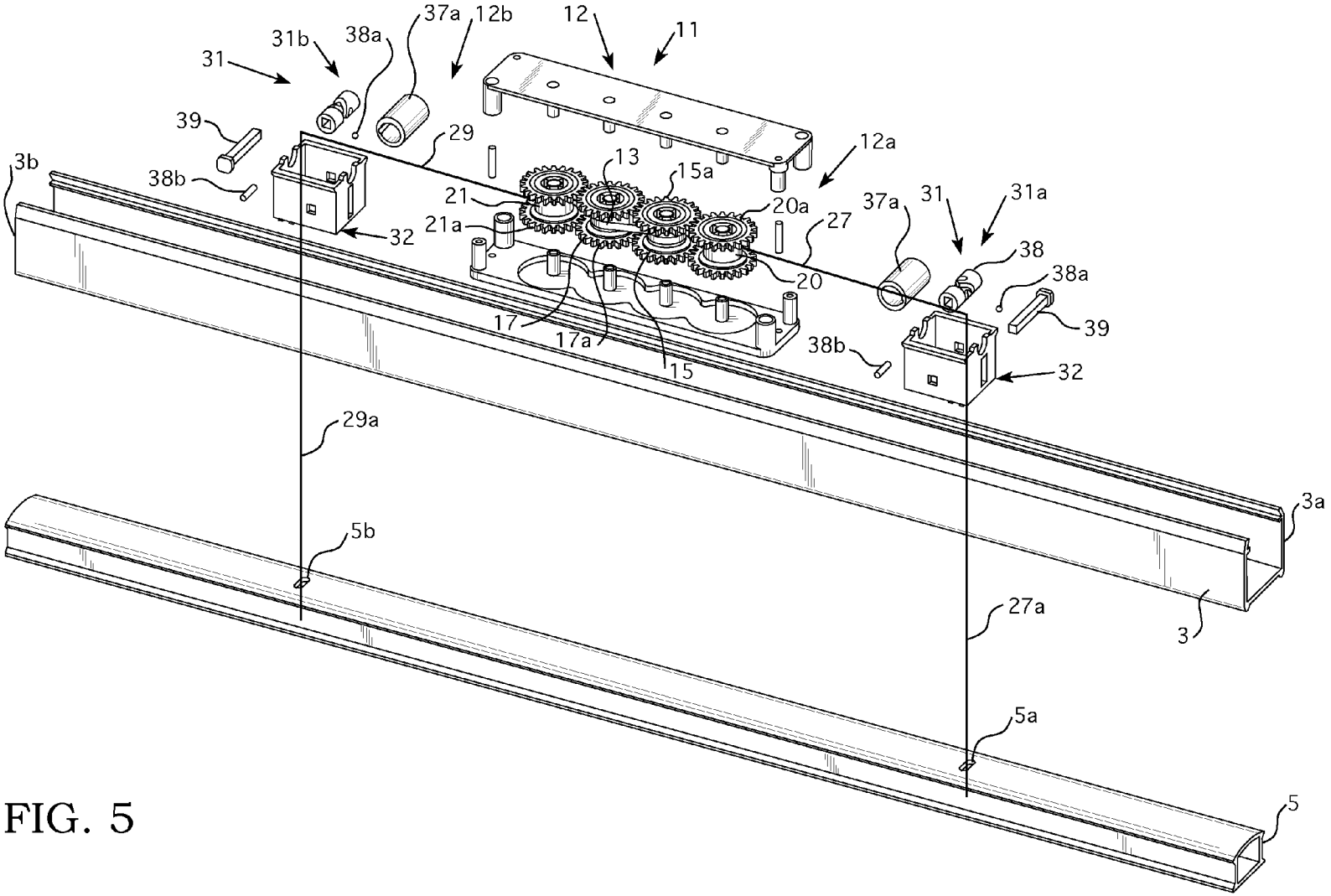
FIG. 5 is an exploded view of the third exemplary embodiment of my window covering with the window covering material cut away to better illustrate lift cord components of the window covering.

Referring to FIG. 5, some embodiments of the window covering 1 can be configured to not include second rail pulleys 40. Those embodiments may be configured so that each lift cord only has one segment vertically extending through the window covering material between the first rail 3 and the second rail 5. Such embodiments may also not include the second roller 35 in each lift cord collection mechanism. Instead, each lift cord collection mechanism may only utilize the first roller 37 as one terminal end of each lift cord may be coupled to the second rail 5 and the opposite terminal end may be coupled to the spring motor unit 12 via a lift cord pulley connected to a spring motor pulley of the spring motor unit 12. For instance, in the embodiment shown in FIG. 5, the first lift cord may extend from the first lift cord pulley 20 to pass along the first roller 37 and extend out of the first rail to the second rail via a single first segment 27*a*. The first terminal end of the first lift cord can be connected to the first lift cord pulley 20 and the second terminal end can be connected to the second rail 5. The second lift cord 29 can have its first terminal end connected to the second lift cord pulley 21 and extend from the second lift cord pulley 21 to pass along the first roller 37 of the second lift cord collection mechanism 31 and then pass out of the first rail 3 to extend through window covering material 7 via a single first segment 29*a* and have its second terminal end coupled to the second rail 5. The first and second lift cord collection mechanisms 31*a* and 31*b* may not include second rollers 35. Alternatively, they may include these second rollers 35 and the second rollers 35 may be utilized for another purpose, such as coupling cord ladders for venetian blind slats to the first rail 3 as may be appreciated from FIG. 6. For such embodiments, retraction of the lift cords by winding the lift cords about the lift cord pulleys causes each lift cord to move along the first roller 37 to which it is entrained. The non-moving of the first roller 37 after the first outer tubular body 37*a* has rotated its pre-selected number of revolutions (or pre-selected number of rotations) via ball 38*a*, rod 38*b* and groove 38*c* can increase the friction on the lift cord as it moves along the first roller 37 during retraction of window covering material to improve the precision of the ability of the spring motor unit 12 to maintain the window covering material at a user selected location. When the lift cords are extended to extend the window covering material, the first roller 37 may freely rotate. In yet other embodiments of the design shown in FIG. 5, the spring motor unit 12 and lift cord collection mechanisms 31 can be located in a bottom rail and the terminal ends of the lift cords that extend from that rail can be affixed to the headrail.

Figure 6:
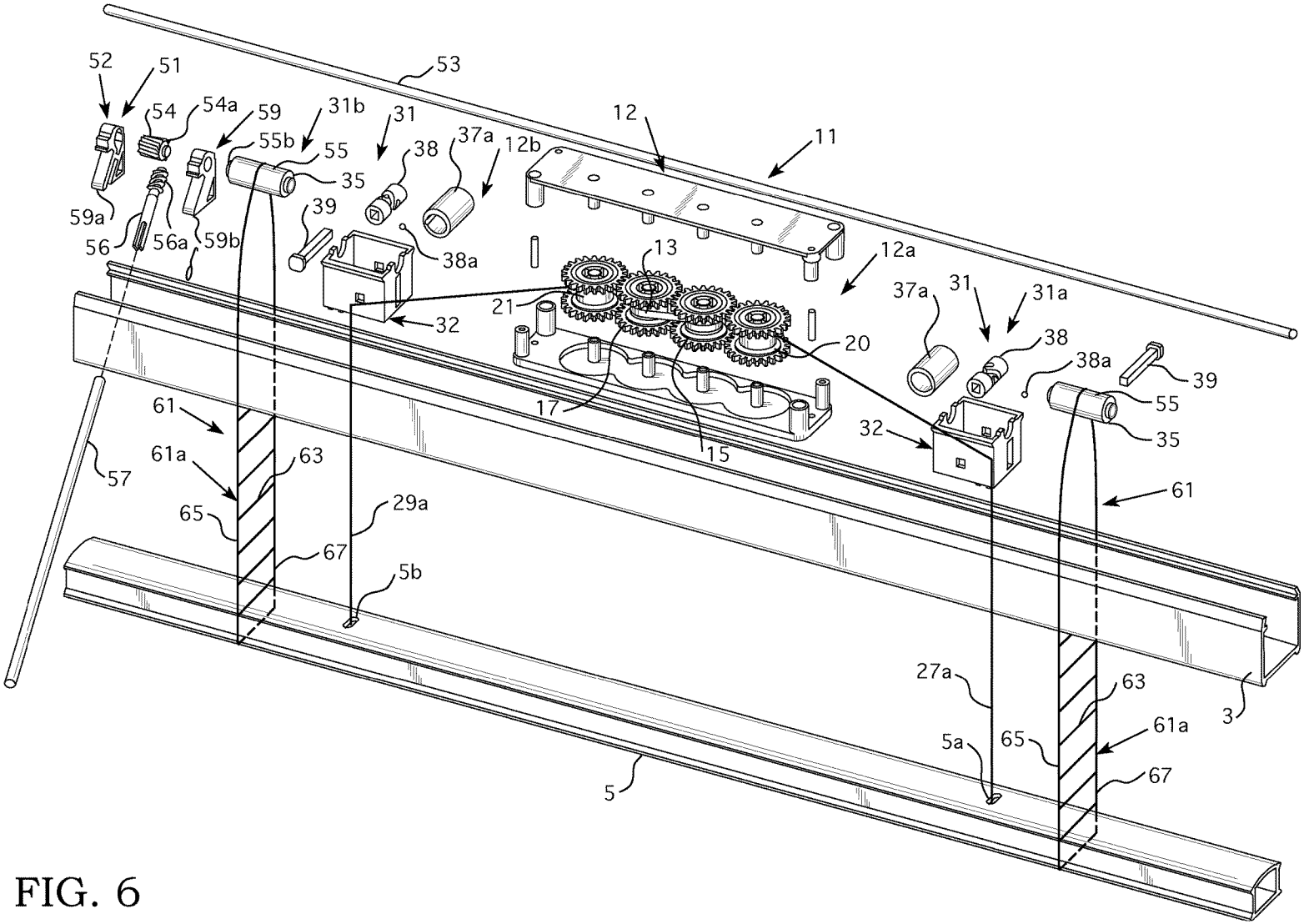
FIG. 6 is an exploded view of the second exemplary embodiment of my window covering, which is configured as a blind, with the slats of the window covering material cut away to better illustrate lift cord and ladder cord components of the window covering.
Figure 7:
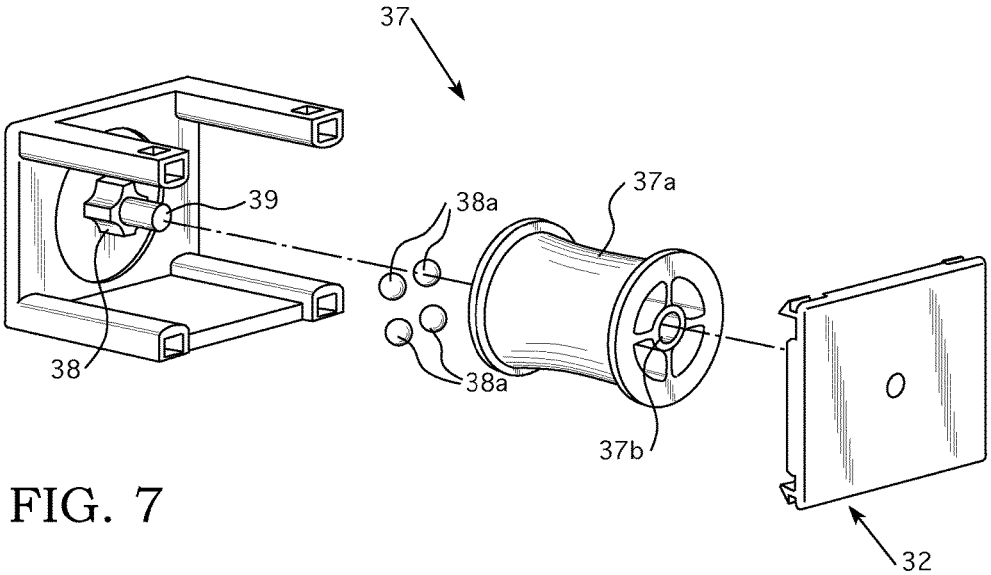
FIG. 7 is an exploded view of an exemplary component of the window covering positional adjustment mechanism that can be utilized in embodiments of my window covering.
Figure 8:
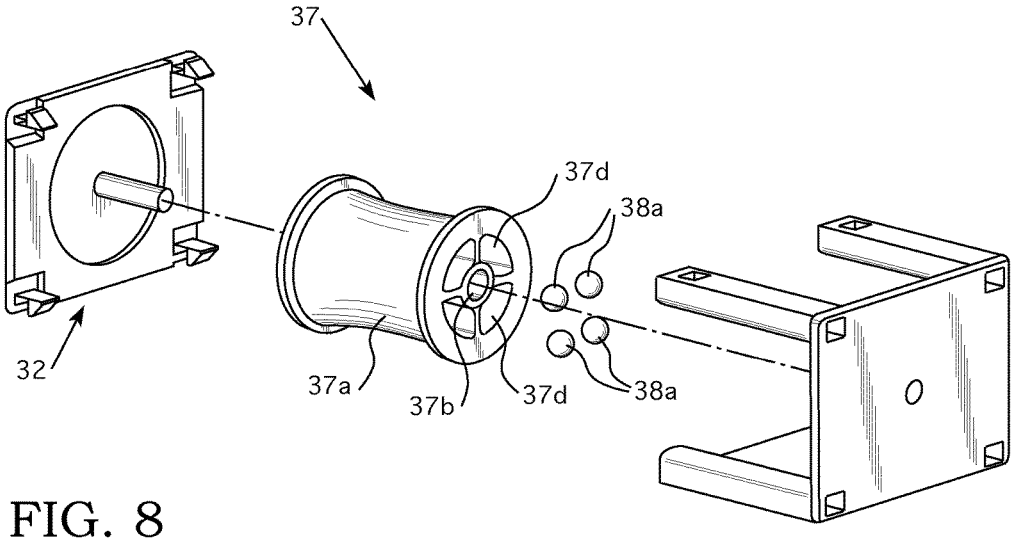
FIG. 8 is an exploded view of the exemplary component of the window covering positional adjustment mechanism shown in FIG. 7 that can be utilized in embodiments of my window covering.
Figure 9:
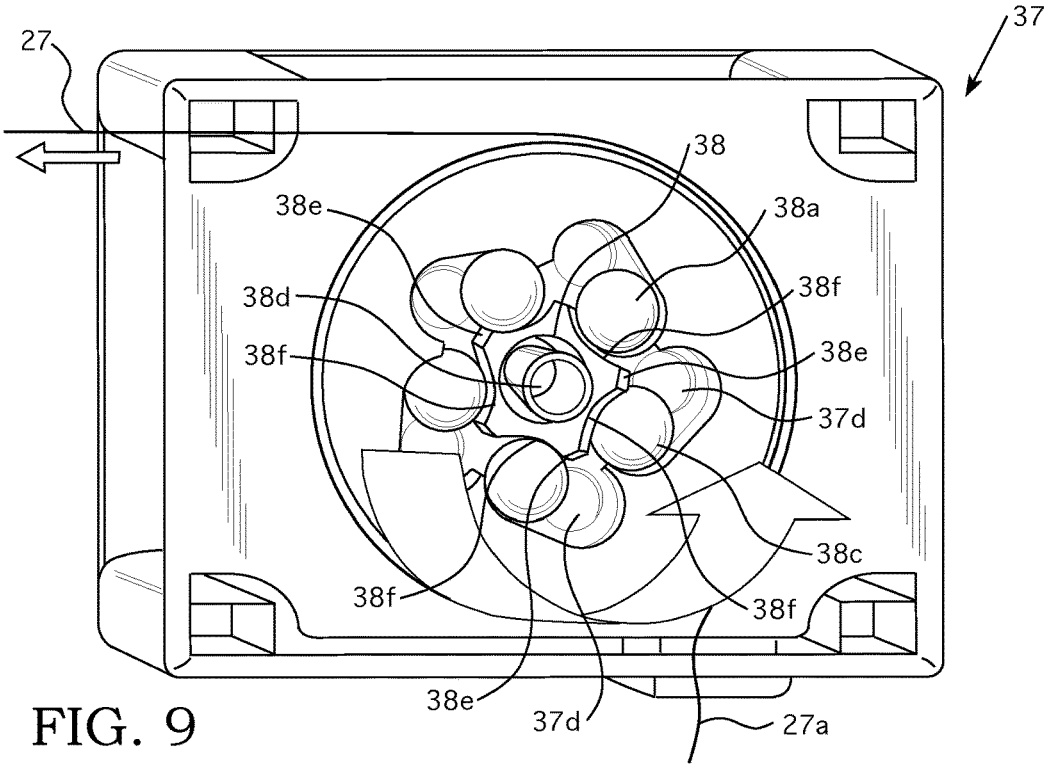
FIG. 9 is a schematic view of the exemplary component of the window covering positional adjustment mechanism shown in FIGS. 7 and 8 to illustrate a roller in a locked position that prevents the roller from rotating in a rotational direction after a pre-selected number of revolutions (e.g. 0.1 revolutions, 0.25 revolutions, 0.5 revolutions, etc.).
Figure 10:
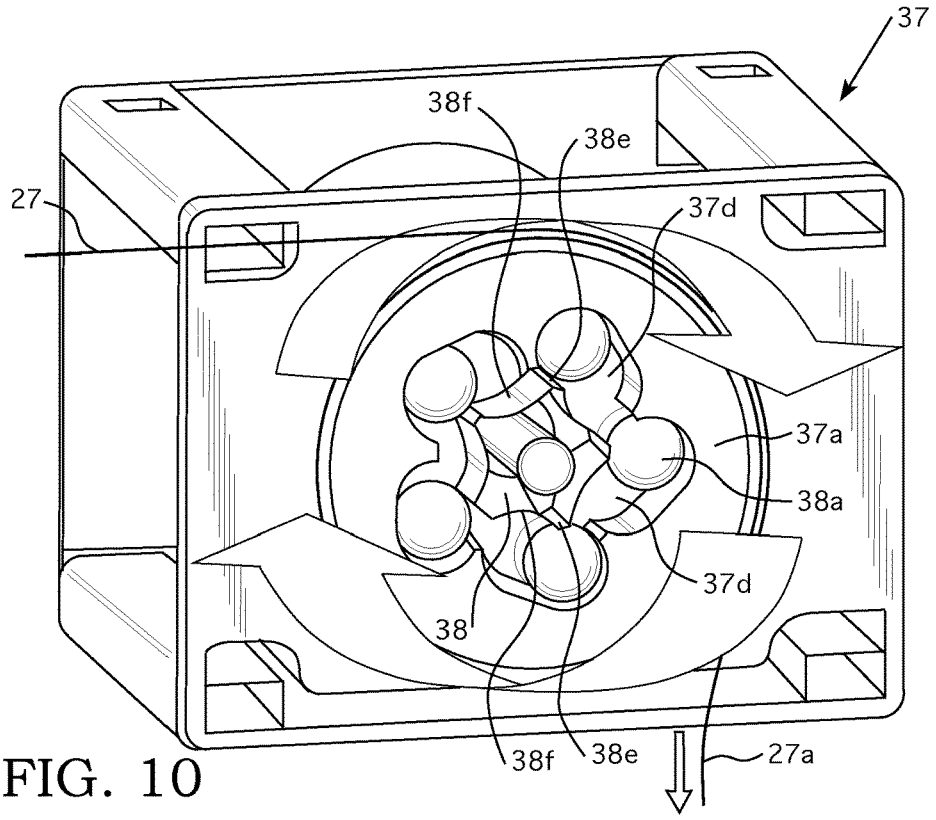
FIG. 10 is a schematic view similar to FIG. 9 of the exemplary component of the window covering positional adjustment mechanism that illustrates the roller in an unlocked position in which it can freely rotate in two different rotational directions.

Referring to FIG. 6, embodiments of the window covering can be configured for use in connection with blinds such as mini blinds or venetian blinds that have slats supported on ladder cords that are tiltable between open and closed positions in addition to being adjustable between raised and lowered positions, or retracted and extended positions. For instance, the window covering 1 can include slats as its window covering material and can have a first ladder cord 61*a* positioned adjacent a first side of the window covering and a second ladder cord 61*b* positioned adjacent a second side of the window covering to support the slats that are suspended from the first rail 3 via the first and second ladder cords 61*a* and 61*b* and the lift cords. Such embodiments may utilize a slat tilt control mechanism 51 that can be incorporated into the positional adjustment mechanism 11 or be usable in conjunction with that mechanism. The slat tilt control mechanism can be connected to the ladders that support the slats and be configured to facilitate adjustment of the orientation of the slats between open and closed positions.

Each ladder cord 61 may be coupled to a respective second roller 35, or ladder cord tilt pulley 55, for extending from the first rail 3 and supporting the slats. For instance, such embodiments of the window covering 1 can be configured so that second rollers 35 are ladder cord tilt pulleys 55 that are coupled to a tilt rod 53 that is positioned in the first rail 3 for facilitating an adjustment in the position of the ladder cords 61 to facilitate tilting of slats between their open and closed positions.

In some embodiments the housing 52 of the slat tilt control mechanism 51 can include a first and second spaced apart walls 52*a* and 52*b* that have apertures that are aligned for receiving an end portion of the tilt rod 53. The tilt rod gear 54 can be integral to the tilt rod or attached to the tilt rod end portion so that when that gear rotates the tilt rod rotates. The tilt rod may extend from adjacent the first end of the rail to the second end of the rail. Each tilt rod pulley may have an inner channel that receives a portion of the tilt rod for being attached to the tilt rod. In other embodiments, each tilt rod pulley 55 can be defined by a portion of the body of the tilt rod or otherwise attached or affixed to the tilt rod. The tilt rod pulleys 55 may have protrusions sized for being received within the first and second upper openings 33*a* and 33*b* of the housing 32 of the lift cord collection mechanism 31 for supporting the tilt rod 53 and tilt rod pulleys 55 in the first rail 3.

The tilt rod 53 may be a shaft or other type of elongated member that has a circular, elliptical, oval, or polygonal cross sectional shape that is positioned in the first rail to support ladder cords 61 that are configured to hold a plurality of slats about rungs 63 of the ladder cords 61 that extend between front and rear rails 65 and 67 of the ladder cords. The ladder cords 61 can be movable to adjust the orientation of the rungs to tilt the slats from an open position in which their front and rear edges are parallel or substantially parallel such that there are gaps defined between immediately adjacent slats and to a tilted position in which the front edges of the slats are vertically higher or lower than the rear edges to close gaps between immediately adjacent slats. In some embodiments, the front edge of a slat can contact an immediately adjacent lower slat's rear edge when the slats are in the tilted position and the slats' rear edge may contact the front edge of an immediately adjacent upper slat when in the tilted, closed position In other embodiments, the front edge of a slat can contact an immediately adjacent upper slat's rear edge when the slats are in the tilted position and the slats' rear edge may contact the front edge of an immediately adjacent lower slat when in the tilted, closed position.

The lift cords can be configured to pass between the front and rear rails 65 and 67 of a respective ladder cord 61 or may pass alongside or adjacent a respective ladder cord 61 when passing through the slats to the bottom rail 5. For instance, the first lift cord 27 can have a first segment 27*a* that extends from the first rail 3, through the slats between the front and rear rails 65 and 67 of a first ladder cord 61*a* that extend from a first ladder cord tilt pulley 55*a* that is coupled to the tilt rod 53 to the second rail 5. The second lift cord 29 can have a first segment 29*a* that extends from the first rail 3, through the slats between the front and rear rails 65 and 67 of a second ladder cord 61*b* that extend from a second ladder cord tilt pulley 55*b* that is coupled to the tilt rod 53 to the second rail 5.

The tilt rod 53 can be connected to an operator wand 57. The slat tilt control mechanism 51 can include a housing 52 that is positionable in the first rail 3 and configured to connect a rotatable tilt rod gear 54 to the tilt rod such that rotation of the tilt rod gear 54 drives rotation of the tilt rod 53 for causing the tilt rod pulleys 55 connected to the tilt rod 53 to rotate about an axis defined by the rotatable tilt rod 53. The tilt rod gear 54 can be positioned to have its teeth 54*a* intermesh with teeth 56*a* of a tilt wand gear 56 that is connectable to an operator wand 57 so that rotation of the wand 57 that may be effected by a user manipulating the operator wand 57 drives rotation of the tilt wand gear 56 about an axis that is perpendicular or substantially perpendicular to an axis about which the tilt rod gear 54 rotates. For instance, the axis about which the tilt wand gear 56 rotates may be perpendicular to or substantially perpendicular to the axis about which the tilt rod 53 and tilt rod pulleys 55 rotate. The axis about which the tilt rod 53 and tilt rod pulleys 55 rotate may be a horizontally extending axis while the axis about which the tilt wand gear 56 rotates may be perpendicular to that horizontal axis, be a vertically extending axis, or be an axis that is at least vertically extending at an angle that is 20°-90° or 30°-60° relative to the horizontal axis of the tilt rod 54 and tilt rod pulleys 55. The rotation of the tilt wand gear 56 powered by the user's manipulation of the operator wand 57 can drive rotation of the tilt rod gear 54, which causes the tilt rod 53 and tilt rod pulleys 55 to rotate. Rotation of the operator wand in a first direction can drive rotation of the tilt wand gear 56 in a first direction about its axis of rotation and also drive rotation of the tilt rod gear 54, tilt rod 53, and tilt rod pulleys 55 about their axis of rotation in a first direction to effect an adjustment to the tilt of the slats from between their closed positions to their open positions. Rotation of the operator wand 57 in a second direction can drive rotation of the tilt wand gear 56 in a second direction about its axis of rotation and also drive rotation of the tilt rod gear 54, tilt rod 53, and tilt rod pulleys 55 in a second direction about their axes of rotation to effect tilting of the slats from between their open positions and closed positions. The rotation of the tilt rod pulleys 55 can cause the front rails 65 of the ladder cords 61 to move relative to the rear rails 67 so that the orientation of the rungs 67 changes from a horizontal orientation (e.g. a slat open position) to an inclined or declined position (e.g. a slat closed position) to effect tilting of the slats to a closed position for facilitating the tilting of the slats between their opened and closed positions.

It should be appreciated that embodiments of the window covering 1, positional adjustment mechanism 11, and method of making and using the window covering can vary to account for different design objectives. For example, the type of window covering material that is utilized may be any of a desired number of different types of material to provide a desired aesthetic effect and/or a desired insulative property. The material may be sheer, may be light filtering, may be light blocking, or may have other properties as well. As another example, the first rail 3 can be composed of a wood, be an extruded metal rail, or be a polymeric rail and also have any number of different structural shapes and configurations (e.g. an elongated beam, a bar, a rod, etc.). The first rail 3 may have an internal conduit defined therein, may have a channel, and may have a cross section that is rounded, circular, oval, polygonal, or have another type of shape. As another example, the second rail 5 can be composed of a wood, be an extruded metal rail, or be a polymeric rail and also have any number of different structural shapes and configurations (e.g. an elongated beam, a bar, a rod, etc.). The second rail 5 may have an internal conduit defined therein, may have a channel, or may be a solid structure with separate cavities formed therein for the position of pulleys 40 and have a cross section that is rounded, circular, oval, polygonal, or have another type of shape.

As yet another example, the first spring motor pulley 15 and the first lift cord pulley 20 may be aligned on the same rotational axis and the second spring motor pulley 17 and second lift cord pulley 21 may be aligned on the same rotational axis. For instance, the first lift cord pulley 20 may be a portion of a double or triple pulley and be a portion of that pulley that also includes a portion that functions as the first spring motor pulley 15 and the second lift cord pulley 21 may be a portion of a double or triple pulley and be a portion of that pulley that also includes a portion that functions as the second spring motor pulley 17.

In embodiments of the window covering that may utilize more than two lift cords, the window covering may have only two lift cord collection mechanisms 31 or more than two such mechanisms. For instance, for embodiments of the window covering 1 that utilize four or six lift cords or more than six lift cords, there may only be first and second lift cord collection mechanisms that interact with multiple lift cords at opposite ends of the first rail 3 or there may be multiple lift cord collection mechanisms 31 located at opposite sides of the first rail 3. Each lift cord collection mechanism 31 may be configured to only be coupled to a single respective lift cord or may be coupled to multiple respective lift cords in such embodiments.

As yet another example, the lift cord collection mechanisms 31 can have different configurations. For instance, it is contemplated that the first and second upper openings 33*a* and 33*b* can be holes defined in middle or lower opposite sides of the housing so that the first and second holes 33*d* and 33*e* may be positioned above these openings so that the first roller 37 is located above the second roller 35 in some embodiments. As another example, it is contemplated that the second roller 35 can be arranged so it extends along its length along the width W of the first rail 3 while the first roller 37 extends along the length L of the first rail in alternative embodiments.

As yet another example, for embodiments that utilize ladder cords 61, each of the ladder cords may be composed of a single cord that has cord segments that defines front and rear rails 65 and 67 of the ladder cord and have spaced apart rungs that are composed of cords or tape that extend between those cord segments. In other embodiments, each of the ladder cords 61 may be composed of tape or be composed of inter connected cords that are connected together to define the front rail 65, rear rail 67 and the rungs 63.

As yet another example, it should be understood that some embodiments of the window covering that do not utilize any slat tilting may not include the slat tilt control mechanism 51 or gear assembly relating to use of an operator wand. For instance, such embodiments may not include a tilt rod 53 or any ladder cord tilt pulleys 55.

Thus, while certain exemplary embodiments of window covering 1, positional adjustment mechanism 11, and methods of making and using the same have been shown and described above, it is to be distinctly understood that the invention is not limited thereto but may be otherwise variously embodied and practiced within the scope of the following claims.

What is claimed is:

1. A window covering comprising:

a first rail;

window covering material that is connected to the first rail such that the window covering material is moveable between an extended position and a retracted position;

a positional adjustment mechanism connected to the first rail, the positional adjustment mechanism comprising:

a spring motor unit;

a first lift cord pulley connected to the spring motor unit;

a first lift cord collection mechanism comprising a first roller positioned in the first rail;

a first lift cord having a first terminal end and a second terminal end opposite the first terminal end, the first terminal end of the first lift cord connected to the first lift cord pulley, the first lift cord extending from the first lift cord pulley through the window covering material such that a portion of the first lift cord passes along the first roller;

the first roller configured such that the first roller rotates in a first rotational direction when the window covering material is moved from the retracted position to the extended position, the first roller configured to rotate in a second rotational direction that is opposite the first rotational direction for only a pre-selected number of revolutions when the window covering material is moved from the extended position to the retracted position such that the first roller no longer rotates in the second rotational direction as the window covering material is moved from the extended position to the retracted position after having rotated the pre-selected number of revolutions in the second rotational direction during retraction of the window covering material;

the first roller comprising:

a first outer tubular body;

a second inner tubular body positioned within the first outer tubular body such that the first outer tubular body is rotatable relative to the second inner tubular body;

the second inner tubular body having a groove defined in an exterior surface of the second inner tubular body;

a ball positioned within the groove between the first outer tubular body and the second inner tubular body, the ball being moveable within the groove during rotation of the first outer tubular body; and a rod positioned within the first outer tubular body to contact the ball during rotation of the first outer tubular body to drive motion of the ball within the groove.

2. The window covering of claim 1, wherein the pre-selected number of revolutions is one of: five revolutions, three revolutions, 1 revolution, 0.5 revolutions, and 0.25 revolutions.

3. The window covering of claim 1, wherein the groove has different depths within the second inner tubular body.

4. The window covering of claim 1, wherein the groove is configured so that the rod contacts the ball and binds against the ball to prevent rotation of the first outer tubular body after the first outer tubular body has rotated in the second rotational direction no more than the pre-selected number of revolutions.

5. The window covering of claim 4, wherein the groove is also configured such that the rod passes over the ball when the first outer tubular body rotates in the first rotational direction.

6. The window covering of claim 1, wherein the spring motor unit is comprised of:

a first spring motor pulley, the first lift cord pulley connected to the first spring motor pulley;

a second spring motor pulley; and a spring member extending between the first and second spring motor pulleys.

7. The window covering of claim 6, comprising:

a second lift cord pulley connected to the second spring motor pulley.

8. A window covering comprising:

a first rail;

window covering material that is connected to the first rail such that the window covering material is moveable between an extended position and a retracted position;

a second rail;

a positional adjustment mechanism connected to the first rail, the positional adjustment mechanism comprising:

a spring motor unit having a first spring motor pulley, a second spring motor pulley, and a spring member extending between the first and second spring motor pulleys;

a first lift cord pulley connected to the first spring motor pulley of the spring motor unit;

a second lift cord pulley connected to the second spring motor pulley of the spring motor unit;

a first lift cord collection mechanism comprising a first roller positioned in the first rail adjacent a first end of the first rail and a second lift cord collection mechanism comprising a first roller positioned in the first rail adjacent a second end of the first rail;

a first lift cord having a first terminal end and a second terminal end opposite the first terminal end, the first terminal end of the first lift cord connected to the first lift cord pulley, the first lift cord extending from the first lift cord pulley through the window covering material such that a portion of the first lift cord passes along the first roller;

the first roller of the first lift cord collection mechanism configured such that the first roller of the first lift cord collection mechanism rotates in a first rotational direction when the window covering material is moved from the retracted position to the extended position, the first roller of the first lift cord collection mechanism also configured to rotate in a second rotational direction that is opposite the first rotational direction for only a pre-selected number of revolutions when the window covering material is moved from the extended position to the retracted position such that the first roller of the first lift cord collection mechanism no longer rotates in the second rotational direction as the window covering material is moved from the extended position to the retracted position after having rotated the pre-selected number of revolutions in the second rotational direction during retraction of the window covering material;

a second lift cord having a first terminal end and a second terminal end opposite the first terminal end, the first terminal end of the second lift cord connected to the second lift cord pulley, the second lift cord extending from the second lift cord pulley through the window covering material such that a portion of the second lift cord passes along the first roller of the second lift cord collection mechanism; and the first roller of the second lift cord collection mechanism configured such that the first roller rotates in a first rotational direction when the window covering is moved from the retracted position to the extended position, the first roller of the second lift cord collection mechanism also configured to rotate in a second rotational direction that is opposite the first rotational direction for only a pre-selected number of revolutions when the window covering material is moved from the extended position to the retracted position such that the first roller of the second lift cord collection mechanism no longer rotates in the second rotational direction as the window covering material is moved from the extended position to the retracted position after having rotated the pre-selected number of revolutions in the second rotational direction during retraction of the window covering material;

a first second rail pulley positioned in the second rail, a portion of the first lift cord extending along the first second rail pulley such that the first lift cord has at least two vertically extending segments passing through the window covering material between the first rail and the second rail; and a second second rail pulley positioned in the second rail, a portion of the second lift cord extending along the second second rail pulley such that the second lift cord has at least two vertically extending segments passing through the window covering material between the first rail and the second rail.

9. The window covering of claim 8, wherein the first roller of the first lift cord collection mechanism and the first roller of the second lift cord collection mechanism each comprise:

a first outer tubular body;

a second inner tubular body positioned within the first outer tubular body such that the first outer tubular body is rotatable relative to the second inner tubular body;

the second inner tubular body having a groove defined in an exterior surface of the second inner tubular body; and a ball positioned within the groove between the first outer tubular body and the second inner tubular body, the ball being moveable within the groove during rotation of the first outer tubular body.

10. A window covering comprising:

a first rail;

window covering material that is connected to the first rail such that the window covering material is moveable between an extended position and a retracted position;

a second rail;

a positional adjustment mechanism connected to the first rail, the positional adjustment mechanism comprising:

a spring motor unit having a first spring motor pulley, a second spring motor pulley, and a spring member extending between the first and second spring motor pulleys;

a first lift cord pulley connected to the first spring motor pulley of the spring motor unit;

a second lift cord pulley connected to the second spring motor pulley of the spring motor unit;

a first lift cord collection mechanism comprising a first roller positioned in the first rail adjacent a first end of the first rail and a second lift cord collection mechanism comprising a first roller positioned in the first rail adjacent a second end of the first rail;

a first lift cord having a first terminal end and a second terminal end opposite the first terminal end, the first terminal end of the first lift cord connected to the first lift cord pulley, the first lift cord extending from the first lift cord pulley through the window covering material such that a portion of the first lift cord passes along the first roller;

the first roller of the first lift cord collection mechanism configured such that the first roller of the first lift cord collection mechanism rotates in a first rotational direction when the window covering material is moved from the retracted position to the extended position, the first roller of the first lift cord collection mechanism also configured to rotate in a second rotational direction that is opposite the first rotational direction for only a pre-selected number of revolutions when the window covering material is moved from the extended position to the retracted position such that the first roller of the first lift cord collection mechanism no longer rotates in the second rotational direction as the window covering material is moved from the extended position to the retracted position after having rotated the pre-selected number of revolutions in the second rotational direction during retraction of the window covering material;

a second lift cord having a first terminal end and a second terminal end opposite the first terminal end, the first terminal end of the second lift cord connected to the second lift cord pulley, the second lift cord extending from the second lift cord pulley through the window covering material such that a portion of the second lift cord passes along the first roller of the second lift cord collection mechanism; and the first roller of the second lift cord collection mechanism configured such that the first roller rotates in a first rotational direction when the window covering is moved from the retracted position to the extended position, the first roller of the second lift cord collection mechanism also configured to rotate in a second rotational direction that is opposite the first rotational direction for only a pre-selected number of revolutions when the window covering material is moved from the extended position to the retracted position such that the first roller of the second lift cord collection mechanism no longer rotates in the second rotational direction as the window covering material is moved from the extended position to the retracted position after having rotated the pre-selected number of revolutions in the second rotational direction during retraction of the window covering material;

wherein the first roller of the first lift cord collection mechanism and the first roller of the second lift cord collection mechanism each comprise:

a first outer tubular body;

a second inner tubular body positioned within the first outer tubular body such that the first outer tubular body is rotatable relative to the second inner tubular body;

the second inner tubular body having a groove defined in an exterior surface of the second inner tubular body;

a ball positioned within the groove between the first outer tubular body and the second inner tubular body, the ball being moveable within the groove during rotation of the first outer tubular body; and a rod positioned within the first outer tubular body to contact the ball during rotation of the first outer tubular body to drive motion of the ball within the groove.

* * * * *